US010304384B2

(12) United States Patent
Saito

(10) Patent No.: US 10,304,384 B2
(45) Date of Patent: May 28, 2019

(54) DISPLAY APPARATUS

(71) Applicant: Japan Display Inc., Tokyo (JP)

(72) Inventor: Keiichi Saito, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/800,899

(22) Filed: Nov. 1, 2017

(65) Prior Publication Data

US 2018/0130413 A1 May 10, 2018

(30) Foreign Application Priority Data

Nov. 4, 2016 (JP) ..... 2016-216595

(51) Int. Cl.
*G09G 3/3233* (2016.01)
*G09G 3/20* (2006.01)

(52) U.S. Cl.
CPC ..... *G09G 3/3233* (2013.01); *G09G 3/2018* (2013.01); *G09G 2300/0852* (2013.01); *G09G 2300/0866* (2013.01); *G09G 2320/0233* (2013.01)

(58) Field of Classification Search
CPC ..... G09G 3/3233; G09G 3/2018; G09G 2320/0233; G09G 2300/0814; G09G 2300/0819; G09G 2300/0852; G09G 2300/0866; G09G 2310/066
USPC ..... 345/215
See application file for complete search history.

(56) References Cited

U.S. PATENT DOCUMENTS

2007/0046587 A1* 3/2007 Takahara ..... G09G 3/3291 345/76

FOREIGN PATENT DOCUMENTS

JP 2016-040575 A 3/2016

* cited by examiner

*Primary Examiner* — Claire X Pappas
*Assistant Examiner* — Ngan T Pham Lu
(74) *Attorney, Agent, or Firm* — K&L Gates LLP

(57) ABSTRACT

According to an aspect, a display apparatus includes a plurality of pixels including light-emitting elements, a video signal driver that applies a video voltage or an initialization voltage to the pixels based on a video signal, a scan signal driver that applies a scan voltage to the pixels based on the video signal, and a controller that controls an initialization period in which the initialization voltage is applied to the pixels and a video voltage writing period in which the video voltage is applied to the pixels, in accordance with the tone of the video signal.

15 Claims, 15 Drawing Sheets

DISPLAY APPARATUS

CROSS-REFERENCE TO RELATED APPLICATIONS

This application claims priority from Japanese Patent Application No. 2016-216595, filed on Nov. 4, 2016, the contents of which are incorporated by reference herein in its entirety.

BACKGROUND

1. Technical Field

The present invention relates to a display apparatus.

2. Description of the Related Art

Organic electro luminescence (EL) display apparatuses, which include self-light-emitting elements such as organic EL elements, display an image by, for example, controlling pixels including organic light-emitting diodes. The tone (gradation level) of the pixels is controlled by, for example, transistors such as thin film transistors (TFTs), as described in Japanese Patent Application Laid-open Publication No. 2016-040575.

SUMMARY

According to an aspect, a display apparatus includes: a plurality of pixels including light-emitting elements; a video signal driver configured to apply a video voltage or an initialization voltage to the pixels based on a video signal; a scan signal driver configured to apply a scan voltage to the pixels based on the video signal; and a controller configured to control an initialization period in which the initialization voltage is applied to the pixels and a video voltage writing period in which the video voltage is applied to the pixels, in accordance with a tone of the video signal.

DETAILED DESCRIPTION

The following fully describes an embodiment of the present invention with reference to the accompanying drawings. The embodiment to be described below is not intended to limit the scope of the present invention. The constituent elements described below include elements that can be easily thought of by those skilled in the art and/or elements that are substantially the same. The constituent elements described below can be combined as appropriate. What is disclosed herein is merely an example. It will be apparent to those skilled in the art that various changes and modifications may be made without departing from the spirit of the present invention, and the changes and modifications are indeed encompassed within the scope of the present invention. To make the description understood more clearly, some of the accompanying drawings schematically illustrate the components in terms of, for example, the width, thickness, and shape compared to the actual state or dimensions thereof. However, such illustration is merely an example and does not limit the scope of the present invention. In the description and the accompanying drawings, like reference signs refer to like constituent elements that have been referred to in the aforementioned drawings, and the detailed description thereof may be omitted.

In this disclosure, when an element is described as being "on" another element, the element can be directly on the other element, or there can be one or more elements between the element and the other element.

A display apparatus including self-light-emitting elements may suffer from striped non-uniformity of luminance that occurs on a displayed image.

For the foregoing reasons, there is a need for a display apparatus that can reduce striped non-uniformity of luminance.

First Embodiment

Figure 1:
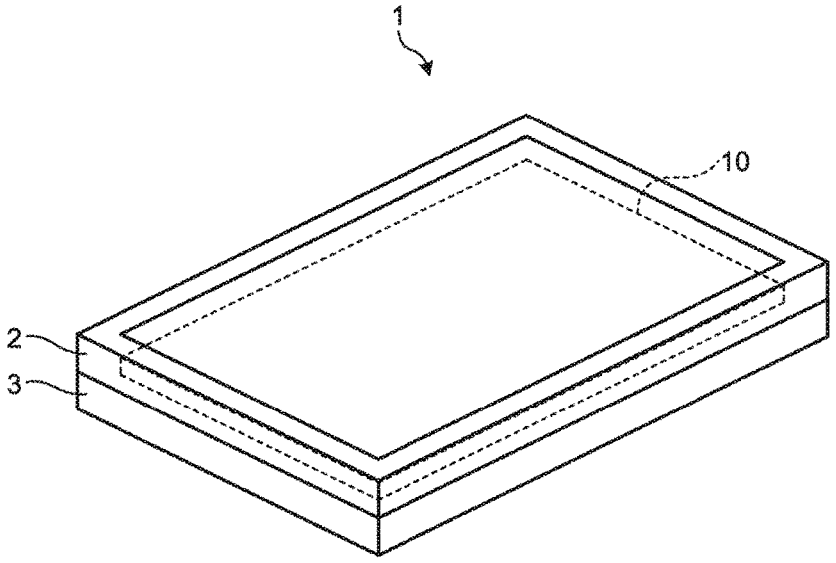
FIG. 1 is a perspective view of a display apparatus according to an embodiment.

FIG. 1 is a perspective view of a display apparatus according to a first embodiment. In the first embodiment, the display apparatus 1 includes an upper frame 2, a lower frame 3, and an organic EL panel 10 including organic EL elements as light-emitting elements. The organic EL panel 10 is fixed by being sandwiched between the upper frame 2 and the lower frame 3. In manufacturing the organic EL panel 10 according to the first embodiment, an annealing process such as the excimer laser annealing (ELA) process is performed in the process of fabricating a thin film transistor (TFT) semiconductor layer, as the low temperature polysilicon array process.

Figure 2:
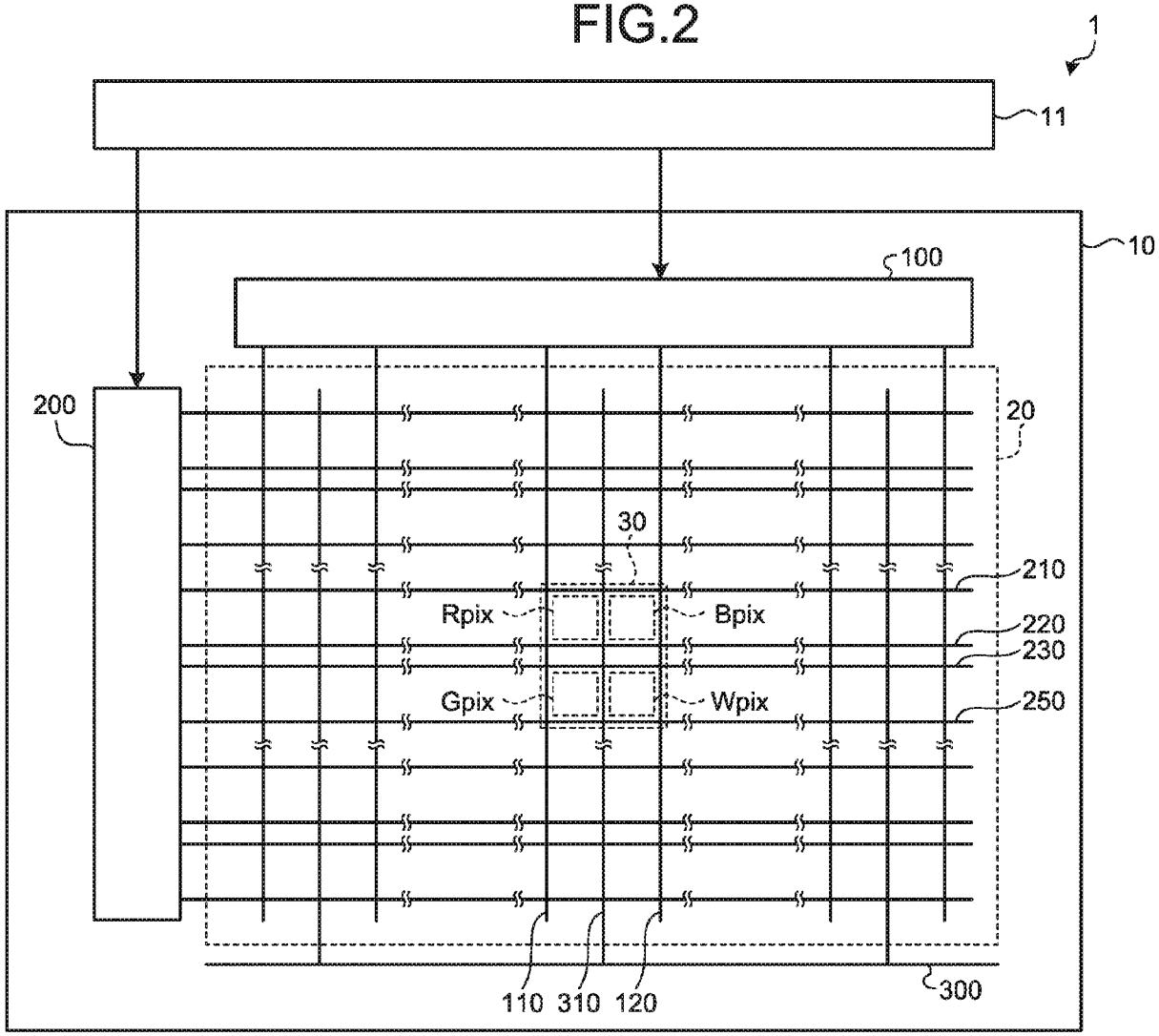
FIG. 2 is a block diagram illustrating a configuration example of the display apparatus according to the embodiment.

FIG. 2 is a block diagram illustrating a configuration example of the display apparatus according to the first embodiment.

As illustrated in FIG. 2, the display apparatus 1 according to the first embodiment includes a controller 11 and the organic EL panel 10. The organic EL panel 10 has a display region 20 in which pixels 30 including organic EL elements and TFTs are arranged in a matrix of columns and rows. The horizontal arrangement in the display region 20 is referred to as a row, and the vertical arrangement in the display region 20 is referred to as a column. In the first embodiment, each pixel 30 includes four subpixels Rpix, Gpix, Bpix, and Wpix. The four subpixels Rpix, Gpix, Bpix, and Wpix included in the pixel 30 emit light in luminescent colors of red (R), green (G), blue (B), and white (W), respectively. The four subpixels collectively function as one pixel 30. The subpixels Rpix, Gpix, Bpix, and Wpix each include a light-emitting element (organic EL element). In the first embodiment, the light-emitting element is an organic light-emitting diode. The organic EL panel 10 uses a video signal driver 100 and a scan signal driver 200 to generate signals for controlling the light-emitting elements to emit light, and displays an image.

The controller 11 controls the video signal driver 100 and the scan signal driver 200 in accordance with a video signal provided from, for example, an external host integrated circuit (IC), which is not illustrated. The controller 11 is included in, for example, an IC, and provides control signals to the video signal driver 100 and the scan signal driver 200 to control these drivers to operate in synchronization with each other.

The controller 11 includes a clock generator (not illustrated) that generates a reference clock. The controller 11 is configured to generate the control signals to be provided to the video signal driver 100 and the scan signal driver 200 on the basis of the reference clock generated by the clock generator.

The video signal driver 100 is an IC that generates a video voltage to be applied to the pixels 30. The scan signal driver 200 is an IC that generates a gate voltage to be applied to the TFT elements included in the pixels 30. Although the video signal driver 100 and the scan signal driver 200 are separately illustrated in FIG. 2, the drivers may be included in a single IC or may be each configured as a circuit directly formed on a substrate.

The video signal driver 100 is coupled to first video signal lines 110 and second video signal lines 120 that vertically extend in the display region 20. The first video signal line 110 is shared by the subpixels (e.g., subpixels Rpix and Gpix arranged in an odd-numbered column in the example of FIG. 2) arranged along the first video signal line 110. The second video signal line 120 is shared by the subpixels (e.g., subpixels Bpix and Wpix arranged in an even-numbered column in the example of FIG. 2) arranged along the second video signal line 120. The first video signal line 110 is coupled to pixel switches included in the subpixels arranged along the first video signal line. The second video signal line 120 is coupled to pixel switches included in the subpixels arranged along the second video signal line. Details of the equivalent circuit of each pixel 30 including the pixel switches will be described with reference to FIG. 3.

The scan signal driver 200 is coupled to first scan signal lines 210, light emission control lines 220, reset lines 230, and second scan signal lines 250 that horizontally extend in the display region 20. The first scan signal line 210 is shared by the subpixels (e.g., subpixels Rpix and Bpix arranged in an odd-numbered row in the example of FIG. 2) arranged along the first scan signal line 210. The second scan signal line 250 is shared by the subpixels (e.g., subpixels Gpix and Wpix arranged in an even-numbered row in the example of FIG. 2) arranged along the second scan signal line 250. The light emission control line 220 and the reset line 230 are shared by the subpixels (e.g., subpixels Rpix, Gpix, Bpix, and Wpix constituting one pixel 30 in the example of FIG. 2) arranged in two rows between a corresponding one of the first scan signal lines 210 and a corresponding one of the second scan signal lines 250.

The organic EL panel 10 includes a high-potential supply line 300. The electric potential of the high-potential supply line 300 is referred to as PVDD. For example, the potential difference between the high-potential supply line 300 and a low-potential supply line (e.g., a ground line), which is not illustrated, is 10 V. The high-potential supply line 300 is coupled to power lines 310. The power line 310 is shared by the subpixels (e.g., subpixels Rpix, Gpix, Bpix, and Wpix constituting one pixel 30 in the example of FIG. 2) arranged along the power line 310, and supplies power for causing the light-emitting elements in the subpixels to emit light.

Figure 3:
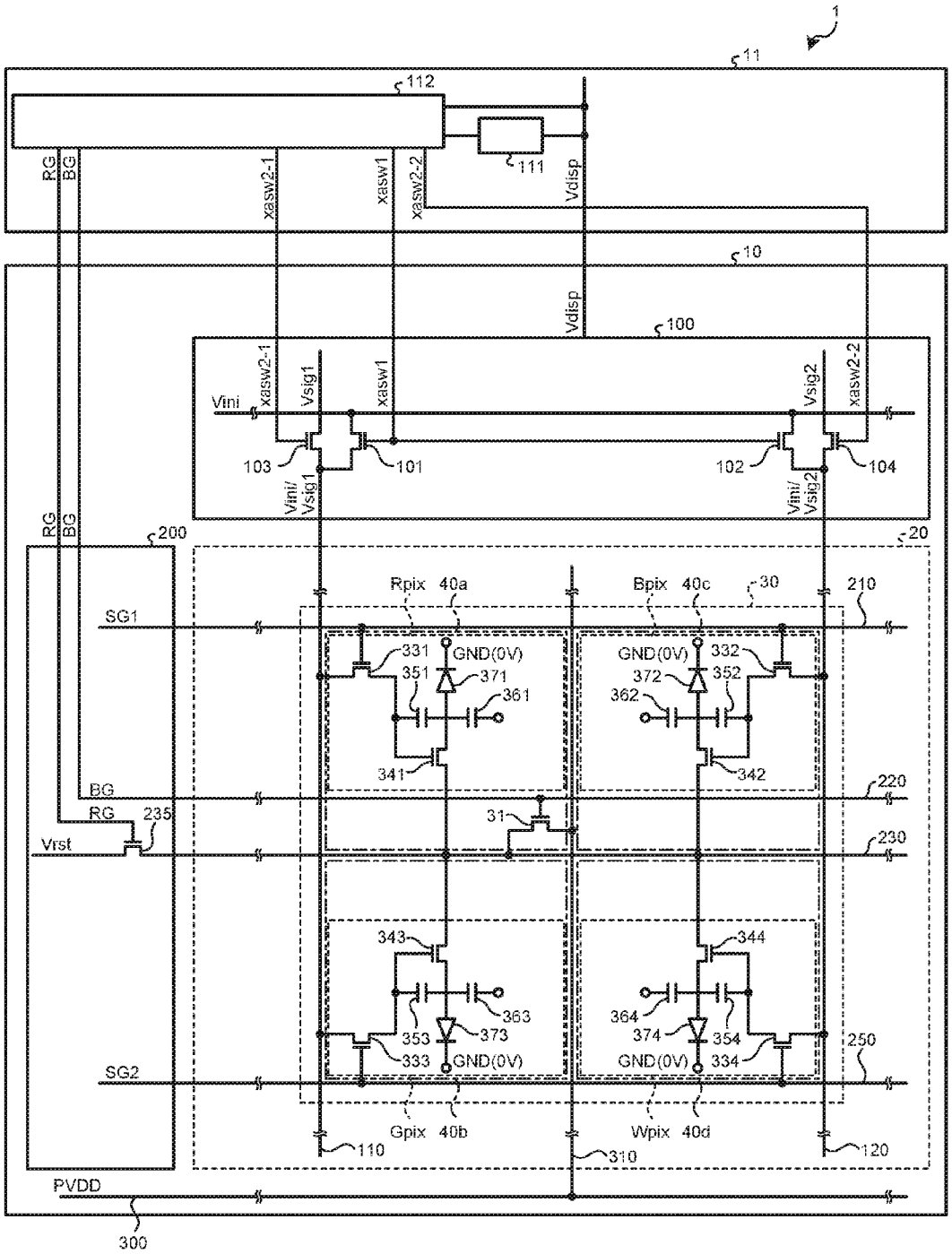
FIG. 3 is a diagram illustrating an example of coupling of components including an equivalent circuit of a pixel in an organic EL panel of the display apparatus according to the embodiment.

FIG. 3 is a diagram illustrating an example of coupling of components including an equivalent circuit of a pixel in the organic EL panel of the display apparatus according to the first embodiment. In the first embodiment as described above, each pixel 30 includes four subpixels Rpix, Gpix, Bpix, and Wpix. The four subpixels Rpix, Gpix, Bpix, and Wpix emit light in luminescent colors of, for example, red (R), green (G), blue (B), and white (W), respectively. The four subpixels Rpix, Gpix, Bpix, and Wpix share one light emission control switch 31. In the first embodiment, the central axis of the reset line 230 is parallel to the horizontal scan lines (the first scan signal line 210 and the second scan signal line 250). A first pixel region 40*a* including a subpixel Rpix and a second pixel region 40*b* including a subpixel Gpix are arranged opposite each other across an axis (central axis of the reset line 230) that is parallel to the horizontal scan lines. A third pixel region 40*c* including a subpixel Bpix and a fourth pixel region 40*d* including a subpixel Wpix are arranged opposite each other across the axis (central axis of the reset line 230) that is parallel to the horizontal scan lines.

The first pixel region 40*a* is a region defined by the first scan signal line 210, the reset line 230, the first video signal line 110 and the power line 310. The second pixel region 40*b* is a region defined by the reset line 230, the second scan signal line 250, the first video signal line 110, and the power line 310.

The controller 11 includes a tone detector 111 and a timing controller 112. The tone detector 111 detects a tone (gradation level) of a video signal Vdisp pixel by pixel. The timing controller 112 generates control signals on the basis of the video signal Vdisp and the tone of the video signal Vdisp that is detected by the tone detector 111 pixel by pixel. The control signals generated by the timing controller 112 include a first timing pulse LP1, a second timing pulse LP2, a third timing pulse LP3, an initialization voltage output timing control signal xasw1, a first video voltage output timing control signal xasw2-1, a second video voltage output timing control signal xasw2-2, a light emission control signal BG, and a reset control signal R. The control signals generated by the controller 11 will be described later.

The video signal driver 100 generates a first video voltage Vsig1 and a second video voltage Vsig2 on the basis of the video signal Vdisp input from the controller 11.

The video signal driver 100 includes a first initialization signal control switch 101, a second initialization signal control switch 102, a first video voltage control switch 103, and a second video voltage control switch 104.

One (first terminal) of the source and the drain of the first initialization signal control switch 101 is coupled to the first video signal line 110, and the other one (second terminal) of the source and the drain thereof is supplied with an initialization voltage Vini. The initialization voltage output timing control signal xasw1 is input to the gate (third terminal) of the first initialization signal control switch 101. In the first embodiment, the first initialization signal control switch 101 is, for example, a transistor. Applying the initialization voltage output timing control signal xasw1 to the gate of the first initialization signal control switch 101 causes the first initialization signal control switch 101 to be in a conductive state, thereby applying the initialization voltage Vini to the first video signal line 110. In the first embodiment, the initialization voltage Vini is, for example, 1.27 V.

One (first terminal) of the source and the drain of the second initialization signal control switch 102 is coupled to the second video signal line 120, and the other one (second terminal) of the source and the drain thereof is supplied with an initialization voltage Vini. The initialization voltage output timing control signal xasw1 is input to the gate (third terminal) of the second initialization signal control switch 102. In the first embodiment, the second initialization signal control switch 102 is, for example, a transistor. Applying the initialization voltage output timing control signal xasw1 to the gate of the second initialization signal control switch 102 causes the second initialization signal control switch 102 to be in a conductive state, thereby applying the initialization voltage Vini to the second video signal line 120.

One (first terminal) of the source and the drain of the first video voltage control switch 103 is coupled to the first video signal line 110, and the other one (second terminal) of the source and the drain thereof is supplied with the first video voltage Vsig1. The first video voltage output timing control signal xasw2-1 is input to the gate (third terminal) of the first video voltage control switch 103. In the first embodiment, the first video voltage control switch 103 is, for example, a transistor. Applying the first video voltage output timing control signal xasw2-1 to the gate of the first video voltage control switch 103 causes the first video voltage control switch 103 to be in a conductive state, thereby applying the first video voltage Vsig1 to the first video signal line 110. In the first embodiment, the first video voltage Vsig1 is a tone signal that varies in accordance with the video signal Vdisp and may have a value, for example, from 0 to 5 V.

One (first terminal) of the source and the drain of the second video voltage control switch 104 is coupled to the second video signal line 120, and the other one (second terminal) of the source and the drain thereof is supplied with the second video voltage Vsig2. The second video voltage output timing control signal xasw2-2 is input to the gate (third terminal) of the second video voltage control switch 104. In the first embodiment, the second video voltage control switch 104 is, for example, a transistor. Applying the second video voltage output timing control signal xasw2-2 to the gate of the second video voltage control switch 104 causes the second video voltage control switch 104 to be in a conductive state, thereby applying the second video voltage Vsig2 to the second video signal line 120. In the first embodiment, the second video voltage Vsig2 is a tone signal that varies in accordance with the video signal Vdisp and may have a value, for example, from 0 to 5 V.

The scan signal driver 200 includes a reset control switch 235.

One (first terminal) of the source and the drain of the reset control switch 235 is coupled to the reset line 230, and the other one (second terminal) of the source and the drain thereof is supplied with a reset voltage Vrst. The reset control signal RG is input to the gate (third terminal) of the reset control switch 235. In the first embodiment, the reset control switch 235 is, for example, a transistor. Applying the reset control signal RG to the gate of the reset control switch 235 causes the reset control switch 235 to be in a conductive state, thereby applying the reset voltage Vrst to the reset line 230. In the first embodiment, the reset voltage Vrst is, for example, −3 V.

The first pixel region 40*a* includes a pixel switch 331, a drive transistor 341, an organic light-emitting diode 371, a storage capacitor 351, and an additional capacitor 361.

One (first terminal) of the source and the drain of the pixel switch 331 is coupled to the first video signal line 110. The gate (third terminal) of the pixel switch 331 is coupled to the first scan signal line 210. In the first embodiment, the pixel switch 331 is, for example, a TFT element.

One (first terminal) of the source and the drain of the drive transistor 341 is coupled to an anode of the organic light-emitting diode 371, and the other one (second terminal) of the source and the drain thereof is coupled to the reset line 230. The gate (third terminal) of the drive transistor 341 is coupled to the other one (second terminal) of the source and the drain of the pixel switch 331. In the first embodiment, the drive transistor 341 is, for example, an n-channel transistor.

The storage capacitor 351 is coupled to between the one (first terminal) of the source and the drain of the drive transistor 341 and the gate (third terminal) thereof. The additional capacitor 361 is coupled to between the one (first terminal) of the source and the drain of the drive transistor 341 and a low-potential supply line (e.g., a ground line) or the high-potential supply line 300. The additional capacitor 361 may be provided between the one (first terminal) of the source and the drain of the drive transistor 341 and the low-potential supply line (e.g., a ground line), and another additional capacitor 361 may be provided between the one (first terminal) of the source and the drain of the drive transistor 341 and the high-potential supply line 300.

Applying a first scan voltage SG1 to the first scan signal line 210 by the scan signal driver 200 causes the pixel switch 331 to be in a conductive state. When the first video voltage Vsig1 is applied to the first video signal line 110 by the video signal driver 100 while the pixel switch 331 is in the conductive state, the first video voltage Vsig1 is applied to the gate (third terminal) of the drive transistor 341.

The drive transistor 341 controls a current value to be supplied to the organic light-emitting diode 371 in accordance with the gate voltage.

Charge accumulates in the storage capacitor 351 while the voltage is applied to the gate (third terminal) of the drive transistor 341. After the pixel switch 331 is switched to a non-conductive state, the charge accumulated in the storage capacitor 351 keeps a voltage level of the gate (third terminal) of the drive transistor 341 for a certain period, and the drive transistor 341 remains conductive for the certain period.

The additional capacitor 361, which is coupled to the one (first terminal) of the source and the drain of the drive transistor 341, serves for setting the voltage between the gate (third terminal) of the drive transistor 341 and the one (first terminal) of the source and the drain thereof in accordance with the voltage level of the first video voltage Vsig1 by using a split capacitance between the storage capacitor 351 and the additional capacitor 361. Specifically, in many cases, the additional capacitor 361 is set to store more charge than the storage capacitor 351 to provide a wide setting range of the voltage between the gate (third terminal) of the drive transistor 341 and the one (first terminal) of the source and the drain thereof.

A cathode of the organic light-emitting diode 371 is coupled to a low-potential supply line (e.g., a ground line). Switching the light emission control switch 31 to a conductive state while the drive transistor 341 is in a conductive state causes a current to flow through the organic light-emitting diode 371 in accordance with the gate voltage of the drive transistor 341, thereby causing the organic light-emitting diode 371 to emit light.

The second pixel region 40*b* includes a pixel switch 333, a drive transistor 343, an organic light-emitting diode 373, a storage capacitor 353, and an additional capacitor 363.

One (first terminal) of the source and the drain of the pixel switch 333 is coupled to the first video signal line 110. The gate (third terminal) of the pixel switch 333 is coupled to the second scan signal line 250. In the first embodiment, the pixel switch 333 is, for example, a TFT element.

One (first terminal) of the source and the drain of the drive transistor 343 is coupled to an anode of the organic light-emitting diode 373, and the other one (second terminal) of the source and the drain thereof is coupled to the reset line 230. The gate (third terminal) of the drive transistor 343 is coupled to the other one (second terminal) of the source and the drain of the pixel switch 333. In the first embodiment, the drive transistor 343 is, for example, an n-channel transistor.

The storage capacitor 353 is coupled to between the one (first terminal) of the source and the drain of the drive transistor 343 and the gate (third terminal) thereof. The additional capacitor 363 is coupled to between the one (first terminal) of the source and the drain of the drive transistor 343 and a low-potential supply line (e.g., a ground line) or the high-potential supply line 300. The additional capacitor 363 may be provided between the one (first terminal) of the source and the drain of the drive transistor 343 and the low-potential supply line (e.g., a ground line), and another additional capacitor 363 may be provided between the one (first terminal) of the source and the drain of the drive transistor 343 and the high-potential supply line 300.

Applying a second scan voltage SG2 to the second scan signal line 250 by the scan signal driver 200 causes the pixel switch 333 to be in a conductive state. When the first video voltage Vsig1 is applied to the first video signal line 110 by the video signal driver 100 while the pixel switch 333 is in a conductive state, the first video voltage Vsig1 is applied to the gate (third terminal) of the drive transistor 343.

The drive transistor 343 controls a current value to be supplied to the organic light-emitting diode 373 in accordance with the gate voltage.

Charge accumulates in the storage capacitor 353 while the voltage is applied to the gate (third terminal) of the drive transistor 343. After the pixel switch 333 is switched to a non-conductive state, the charge accumulated in the storage capacitor 353 keeps a voltage level of the gate (third terminal) of the drive transistor 343 for a certain period, and the drive transistor 343 remains conductive for the certain period.

The additional capacitor 363, which is coupled to the one (first terminal) of the source and the drain of the drive transistor 343, serves for setting the voltage between the gate (third terminal) of the drive transistor 343 and the one (first terminal) of the source and the drain thereof in accordance with the voltage level of the first video voltage Vsig1 by using a split capacitance between the storage capacitor 353 and the additional capacitor 363. Specifically, in many cases, the additional capacitor 363 is set to store more charge than the storage capacitor 353 to provide a wide setting range of the voltage between the gate (third terminal) of the drive transistor 343 and the one (first terminal) of the source and the drain thereof.

A cathode of the organic light-emitting diode 373 is coupled to a low-potential supply line (e.g., a ground line). Switching the light emission control switch 31 to a conductive state while the drive transistor 343 is in a conductive state causes a current to flow through the organic light-emitting diode 373 in accordance with the gate voltage of the drive transistor 343, thereby causing the organic light-emitting diode 373 to emit light.

The third pixel region 40*c* includes a pixel switch 332, a drive transistor 342, an organic light-emitting diode 372, a storage capacitor 352, and an additional capacitor 362.

One (first terminal) of the source and the drain of the pixel switch 332 is coupled to the second video signal line 120. The gate (third terminal) of the pixel switch 332 is coupled to the first scan signal line 210. In the first embodiment, the pixel switch 332 is, for example, a TFT element.

One (first terminal) of the source and the drain of the drive transistor 342 is coupled to an anode of the organic light-emitting diode 372, and the other one (second terminal) of the source and the drain thereof is coupled to the reset line 230. The gate (third terminal) of the drive transistor 342 is coupled to the other one (second terminal) of the source and the drain of the pixel switch 332. In the first embodiment, the drive transistor 342 is, for example, an n-channel transistor.

The storage capacitor 352 is coupled to between the one (first terminal) of the source and the drain of the drive transistor 342 and the gate (third terminal) thereof. The additional capacitor 362 is coupled to between the one (first terminal) of the source and the drain of the drive transistor 342 and a low-potential supply line (e.g., a ground line) or the high-potential supply line 300. The additional capacitor 362 may be provided between the one (first terminal) of the source and the drain of the drive transistor 342 and the low-potential supply line (e.g., a ground line), and another additional capacitor 363 may be provided between the one (first terminal) of the source and the drain of the drive transistor 342 and the high-potential supply line 300.

Applying a first scan voltage SG1 to the first scan signal line 210 by the scan signal driver 200 causes the pixel switch 332 to be in a conductive state. When the second video voltage Vsig2 is applied to the second video signal line 120 by the video signal driver 100 while the pixel switch 332 is in a conductive state, the second video voltage Vsig2 is applied to the gate (third terminal) of the drive transistor 342.

The drive transistor 342 controls a current value to be supplied to the organic light-emitting diode 372 in accordance with the gate voltage.

Charge accumulates in the storage capacitor 352 while the voltage is applied to the gate (third terminal) of the drive transistor 342. After the pixel switch 332 is switched to a non-conductive state, the charge accumulated in the storage capacitor 352 keeps a voltage level of the gate (third terminal) of the drive transistor 342 for a certain period, and the drive transistor 342 remains conductive for the certain period.

The additional capacitor 362, which is coupled to the one (first terminal) of the source and the drain of the drive transistor 342, serves for setting the voltage between the gate (third terminal) of the drive transistor 342 and the one (first terminal) of the source and the drain thereof in accordance with the voltage level of the second video voltage Vsig2 by using a split capacitance between the storage capacitor 352 and the additional capacitor 362. Specifically, in many cases, the additional capacitor 362 is set to store more charge than the storage capacitor 352 to provide a wide setting range of the voltage between the gate (third terminal) of the drive transistor 342 and the one (first terminal) of the source and the drain thereof.

A cathode of the organic light-emitting diode 372 is coupled to a low-potential supply line (e.g., a ground line). Switching the light emission control switch 31 to a conductive state while the drive transistor 342 is in a conductive state causes a current to flow through the organic light-emitting diode 372 in accordance with the gate voltage of the drive transistor 342, thereby causing the organic light-emitting diode 372 to emit light.

The fourth pixel region 40*d* includes a pixel switch 334, a drive transistor 344, an organic light-emitting diode 374, a storage capacitor 354, and an additional capacitor 364.

One (first terminal) of the source and the drain of the pixel switch 334 is coupled to the second video signal line 120. In the first embodiment, the pixel switch 334 is, for example, a TFT element.

One (first terminal) of the source and the drain of the drive transistor 344 is coupled to an anode of the organic light-emitting diode 374, and the other one (second terminal) of the source and the drain thereof is coupled to the reset line 230. The gate (third terminal) of the drive transistor 344 is coupled to the other one (second terminal) of the source and the drain of the pixel switch 334. In the first embodiment, the drive transistor 344 is, for example, an n-channel transistor.

The storage capacitor 354 is coupled to between the one (first terminal) of the source and the drain of the drive transistor 344 and the gate (third terminal) thereof. The additional capacitor 364 is coupled to between the one (first terminal) of the source and the drain of the drive transistor 344 and a low-potential supply line (e.g., a ground line) or the high-potential supply line 300. The additional capacitor 364 may be provided between the one (first terminal) of the source and the drain of the drive transistor 344 and the low-potential supply line (e.g., a ground line), and another additional capacitor 364 may be provided between the one (first terminal) of the source and the drain of the drive transistor 342 and the high-potential supply line 300.

Applying a second scan voltage SG2 to the second scan signal line 250 by the scan signal driver 200 causes the pixel switch 334 to be in a conductive state. When the second video voltage Vsig2 is applied to the second video signal line 120 by the video signal driver 100 while the pixel switch 334 is in a conductive state, the second video voltage Vsig2 is applied to the gate (third terminal) of the drive transistor 344.

The drive transistor 344 controls a current value to be supplied to the organic light-emitting diode 374 in accordance with the gate voltage.

Charge accumulates in the storage capacitor 354 while the voltage is applied to the gate (third terminal) of the drive transistor 344. After the pixel switch 334 is switched to a non-conductive state, the charge accumulated in the storage capacitor 354 keeps a voltage level of the gate (third terminal) of the drive transistor 344 for a certain period, and the drive transistor 344 remains conductive for the certain period.

The additional capacitor 364, which is coupled to the one (first terminal) of the source and the drain of the drive transistor 344, serves for setting the voltage between the gate (third terminal) of the drive transistor 344 and the one (first terminal) of the source and the drain thereof in accordance with the voltage level of the second video voltage Vsig2 by using a split capacitance between the storage capacitor 354 and the additional capacitor 364. Specifically, in many cases, the additional capacitor 364 is set to store more charge than the storage capacitor 354 to provide a wide setting range of the voltage between the gate (third terminal) of the drive transistor 344 and the one (first terminal) of the source and the drain thereof.

A cathode of the organic light-emitting diode 374 is coupled to a low-potential supply line (e.g., a ground line). Switching the light emission control switch 31 to a conductive state while the drive transistor 344 is in a conductive state causes a current to flow through the organic light-emitting diode 374 in accordance with the gate voltage of the drive transistor 344, thereby causing the organic light-emitting diode 374 to emit light.

The light emission control switch 31 controls the electrical coupling between the power line 310 and the other one (second terminal) of the source and the drain of each of the drive transistors 341, 342, 343, and 344. In the first embodiment, the light emission control switch 31 is, for example, an n-channel transistor. The gate (third terminal) of the light emission control switch 31 is coupled to the light emission control line 220. Applying the light emission control signal BG to the light emission control line 220 by the scan signal driver 200 causes the light emission control switch 31 to be in a conductive state.

When the light emission control switch 31 is in a non-conductive state and the reset control switch 235 is in a conductive state, the other one (second terminal) of the source and the drain of each of the drive transistors 341, 342, 343, and 344 is coupled to the reset line 230. The reset voltage Vrst may be the potential of the low-potential supply line (e.g., a ground line).

The equivalent circuit illustrated in FIG. 3 is merely an example, and may have a different circuit configuration. For example, the light emission control switch 31 may be provided to each of the four subpixels Rpix, Gpix, Bpix, and Wpix.

For the first initialization signal control switch 101, the second initialization signal control switch 102, the first video voltage control switch 103, the second video voltage control switch 104, the reset control switch 235, the pixel switches 331, 332, 333, and 334, the drive transistors 341, 342, 343, and 344, and the light emission control switch 31 described above, whether the source or the drain corresponds to the first or the second terminal is determined as appropriate in accordance with the circuit configurations of the video signal driver 100, the scan signal driver 200, the first pixel region 40*a*, the second pixel region 40*b*, the third pixel region 40*c*, and the fourth pixel region 40*d*.

Figure 4:
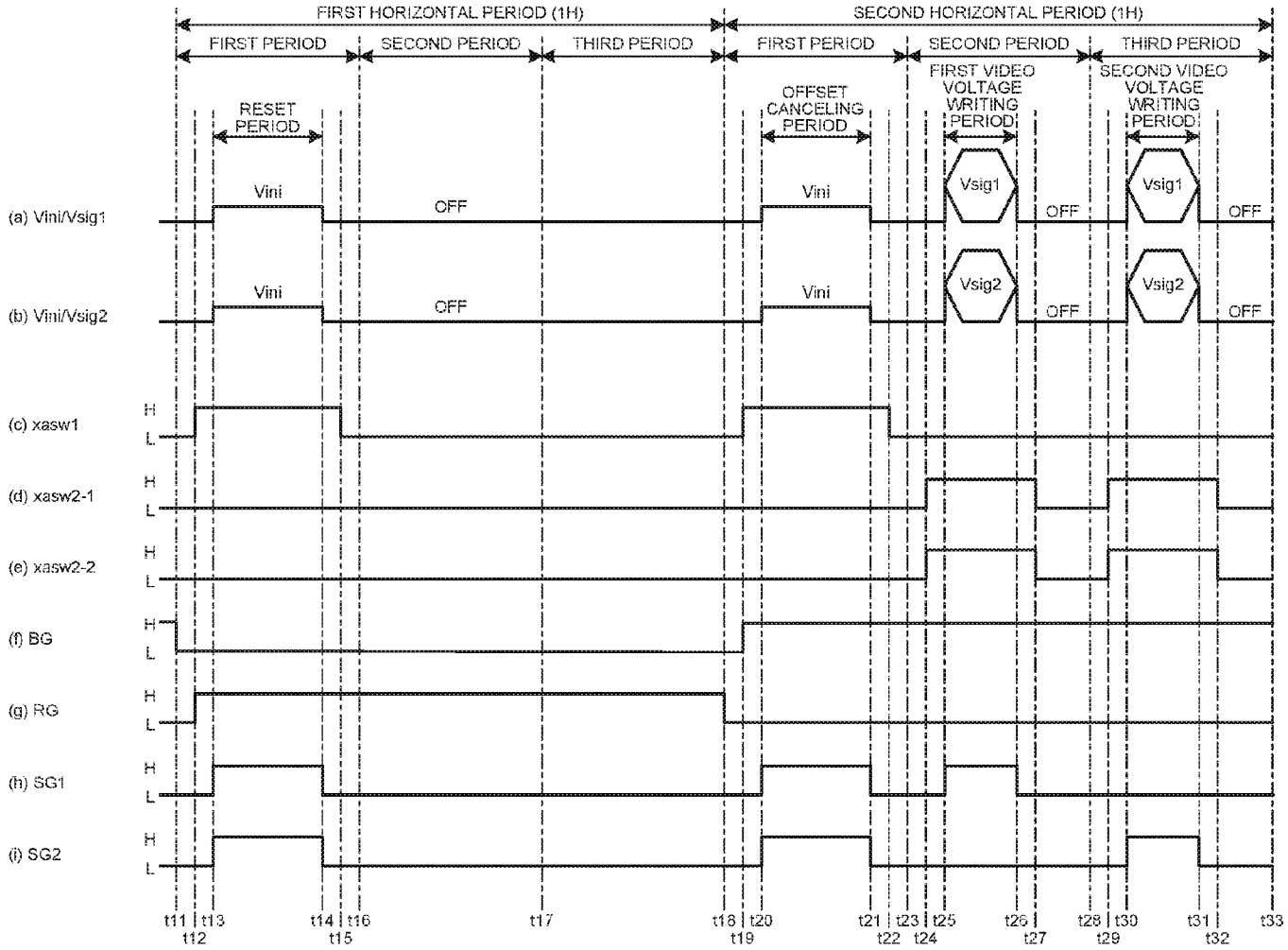
FIG. 4 is a timing chart of control signals used in the display apparatus according to the embodiment.

The following describes a detailed operation of the display apparatus 1 according to the first embodiment. FIG. 4 is a timing chart of the control signals used in the display apparatus according to the first embodiment.

In the timing chart illustrated in FIG. 4, the horizontal axis represents time. In FIG. 4, (a) represents the initialization voltage Vini or the first video voltage Vsig1 to be supplied from the video signal driver 100 to the first video signal line 110. In FIG. 4, (b) represents the initialization voltage Vini or the second video voltage Vsig2 to be supplied from the video signal driver 100 to the second video signal line 120. In the example of (a) in FIG. 4, the vertical axis represents the magnitude of the initialization voltage Vini or the first video voltage Vsig1. In the example of (b) in FIG. 4, the vertical axis represents the magnitude of the initialization voltage Vini or the second video voltage Vsig2.

In FIG. 4, (c) represents the initialization voltage output timing control signal xasw1 to be supplied from the controller 11 to the video signal driver 100. In FIG. 4, (d) represents the first video voltage output timing control signal xasw2-1 to be supplied from the controller 11 to the video signal driver 100. In FIG. 4, (e) represents the second video voltage output timing control signal xasw2-2 to be supplied from the controller 11 to the video signal driver 100. In FIG. 4, (f) represents the light emission control signal BG to be supplied from the controller 11 to the scan signal driver 200. In FIG. 4, (g) represents the reset control signal RG to be supplied from the controller 11 to the scan signal driver 200. In FIG. 4, (h) represents the first scan voltage SG1 to be supplied from the scan signal driver 200 to the first scan signal line 210. In FIG. 4, (i) represents the second scan voltage SG2 to be supplied from the scan signal driver 200 to the first scan signal line 210. In the examples of (c), (d), (e), (f), (g), (h), and (i) in FIG. 4, the vertical axis represents a logic low (L) and a logic high (H) of the signals.

The display apparatus 1 according to the first embodiment displays an image by performing raster scanning. In the first embodiment, a plurality of pixel rows constituting the display region 20 of the organic EL panel 10 are selected in order from the first row, and the first video voltage Vsig1 and the second video voltage Vsig2 are written in the pixels 30 of the selected row to cause the pixels 30 to emit light. This operation is repeated for each video signal Vdisp representing one frame. The writing operation according to the first embodiment is divided into a reset operation, an offset canceling operation, and a video voltage writing operation.

In the display apparatus 1 according to the first embodiment, the reset operation, the offset canceling operation, and the video voltage writing operation are performed for each pixel row in two horizontal periods (2H). In the example of FIG. 4, one horizontal period (1H) is divided into three periods: a first period; a second period; and a third period. The reset operation is performed in the first period of the former horizontal period (1H) for each pixel row. Hereinafter, the former horizontal period (1H) is referred to as a first horizontal period. The offset canceling operation is then performed in the first period of the latter horizontal period (1H), and the video voltage writing operation is performed in the following second and third periods in the second horizontal period. Hereinafter, the latter horizontal period (1H) is referred to as a second horizontal period. In the first embodiment, as illustrated in FIG. 3, each pixel 30 is configured by the first pixel region 40*a*, the second pixel region 40*b*, the third pixel region 40*c*, and the fourth pixel region 40*d*. The first video voltage Vsig1 is supplied to the first pixel region 40*a* and the second pixel region 40*b* in the second period of the second horizontal period. The second video voltage Vsig2 is supplied to the third pixel region 40*c* and the fourth pixel region 40*d* in the third period of the second horizontal period.

In the example of FIG. 4, a period from time t11 to time t18 is the first horizontal period, a period from time t11 to time t16 is the first period of the first horizontal period, a period from time t16 to time t17 is the second period of the first horizontal period, and a period from time t17 to time t18 is the third period of the first horizontal period. Further, a period from time t18 to time t33 is the second horizontal period, a period from time t18 to time t23 is the first period of the second horizontal period, a period from time t23 to time t28 is the second period of the second horizontal period, and a period from time t28 to time t33 is the third period of the second horizontal period.

First, the reset operation is described.

At time t11 in the first horizontal period, the logic of the light emission control signal BG is switched from "H" to "L". Subsequently at time t12, the logic of the reset control signal RG is switched from "L" to "H", which causes the reset control switch 235 to be in a conductive state to supply the reset voltage Vrst to the reset line 230. The reset voltage Vrst is then applied to the other one (second terminal) of the source and the drain of each of the drive transistors 341, 342, 343, and 344. At the same time, the logic of the initialization voltage output timing control signal xasw1 is controlled to switch from "L" to "H" in synchronization with the reset control signal RG, which causes the first initialization signal control switch 101 and the second initialization signal control switch 102 to be in a conductive state. The video signal driver 100 then begins to load data of the initialization voltage Vini and supplies the initialization voltage Vini to the first video signal line 110 and the second video signal line 120.

Subsequently at time t13, the logic of the first scan voltage SG1 and the logic of the second scan voltage SG2 are switched from "L" to "H", which causes the pixel switches 331, 332, 333, and 334 to be in a conductive state. The initialization voltage Vini is then applied to the gates (third terminals) of the drive transistors 341, 342, 343, and 344 via the corresponding pixel switches 331, 332, 333, and 334.

With this process, the potentials of the gates (third terminal) of the drive transistors 341, 342, 343, and 344 are set to a potential corresponding to the initialization voltage Vini. Switching the drive transistors 341, 342, 343, and 344 to the conductive state resets the potential of the one (first terminal) of the source and the drain of each of the drive transistors 341, 342, 343, and 344 to the potential corresponding to the reset voltage Vrst, and the voltage across each of the storage capacitors 351, 352, 353, and 354 is set to a voltage corresponding to (Vini−Vrst). The voltage to be applied to the organic light-emitting diodes 371, 372, 373, and 374 becomes a voltage corresponding to (Vrst−GND). The reset voltage Vrst is set such that the voltage to be applied to the organic light-emitting diodes 371, 372, 373, and 374 is equal to or lower than a light emission threshold voltage (light emission start voltage) of the organic light-emitting diodes 371, 372, 373, and 374. The light emission threshold voltage is, for example, a voltage at which a current begins to flow through the organic light-emitting diodes 371, 372, 373, and 374, that is, a forward voltage drop. The initialization voltage Vini can be set to, for example, 1.27 V. The reset voltage Vrst can be set to, for example, −3 V.

At time t14, the logic of the first scan voltage SG1 and the logic of the second scan voltage SG2 are switched from "H" to "L", which causes the pixel switches 331, 332, 333, and 334 to be in a non-conductive state, and the reset operation is ended. Subsequently at time t15, the logic of the initialization voltage output timing control signal xasw1 is switched from "H" to "L", which causes the first initialization signal control switch 101 and the second initialization signal control switch 102 to be in a non-conductive state, and the video signal driver 100 stops loading the data of the initialization voltage Vini. In the following description, a period from time t13 to time t14 in the first period of the first horizontal period is referred to as a "reset period".

Described next is the offset canceling operation.

At time t18 in the second horizontal period, the logic of the reset control signal RG is switched from "H" to "L". Subsequently at time t19, the logic of the light emission control signal BG is switched from "L" to "H", which causes the light emission control switch 31 to be in a conductive state such that the power voltage PVDD is supplied to the reset line 230. The power voltage PVDD is then applied to the other one (second terminal) of the source and the drain of each of the drive transistors 341, 342, 343, and 344. At the same time, the logic of the initialization voltage output timing control signal xasw1 is switched from "L" to "H" in synchronization with the light emission control signal BG, which causes the first initialization signal control switch 101 and the second initialization signal control switch 102 to be in a conductive state. The video signal driver 100 then begins to load the data of the initialization voltage Vini and supplies the initialization voltage Vini to the first video signal line 110 and the second video signal line 120.

Subsequently at time t20, the logic of the first scan voltage SG1 and the logic of the second scan voltage SG2 are switched from "L" to "H", which causes the pixel switches 331, 332, 333, and 334 to be in a conductive state. The initialization voltage Vini is then applied to the gates (third terminals) of the drive transistors 341, 342, 343, and 344 via the corresponding pixel switches 331, 332, 333, and 334.

With this process, the potentials of the gates (third terminals) of the drive transistors 341, 342, 343, and 344 are fixed to a potential corresponding to the initialization voltage Vini. The light emission control switch 31 is in the conductive state, and thus a current flows from the power line 310 to the drive transistors 341, 342, 343, and 344, thereby increasing the potential of the one (first terminal) of the source and the drain of each of the drive transistors 341, 342, 343, and 344 from the reset voltage Vrst that has been written in the reset operation. When the potential of the one (first terminal) of the source and the drain reaches to a voltage (Vini−Vth) that is lower than the potential of the gate (third terminal) by the threshold voltage Vth of the pixel switches 331, 332, 333, and 334, the pixel switches 331, 332, 333, and 334 are switched to a non-conductive state, and the potential of the one (first terminal) of the source and the drain is fixed to the voltage (Vini−Vth). Thus, the voltage across each of the storage capacitors 351, 352, 353, and 354 is set to a voltage corresponding to the threshold voltage Vth. Based on this state, a voltage corresponding to the video voltage (the first video voltage Vsig1 and the second video voltage Vsig2) is written in the storage capacitors 351, 352, 353, and 354 in a video voltage writing operation to be described later. With this process, the effects caused by the differences in threshold voltages Vth of the drive transistors 341, 342, 343, and 344 among pixels can be eliminated from the current flowing to the organic light-emitting diodes 371, 372, 373, and 374 in the light emitting operation.

At time t21, the logic of the first scan voltage SG1 and the logic of the second scan voltage SG2 are switched from "H" to "L", which causes the pixel switches 331, 332, 333, and 334 to be in a non-conductive state, and the offset canceling operation is ended. Subsequently at time t22, the logic of the initialization voltage output timing control signal xasw1 is switched from "H" to "L", which causes the first initialization signal control switch 101 and the second initialization signal control switch 102 to be in a non-conductive state, and the video signal driver 100 stops loading the data of the initialization voltage Vini. In the following description, the period from time t20 to time t21 in the first period of the second horizontal period is referred to as an "offset canceling period".

Described next is the video voltage writing operation.

In the second period and the third period of the second horizontal period, the logic of the reset control signal RG remains "L" and the logic of the light emission control signal BG remains "H" as in the offset canceling period.

At time t24 in the second horizontal period, the logic of the first video voltage output timing control signal xasw2-1 and the logic of the second video voltage output timing control signal xasw2-2 are switched from "L" to "H", which causes the first video voltage control switch 103 and the second video voltage control switch 104 to be in a conductive state. Accordingly, the first video voltage Vsig1 is supplied to the first video signal line 110, and the second video voltage Vsig2 is supplied to the second video signal line 120. Subsequently at time t25, the logic of the first scan voltage SG1 is switched from "L" to "H", which causes the pixel switches 331 and 332 to be in a conductive state. With this process, the potential of the gate (third terminal) of the drive transistor 341 increases from a potential corresponding to the initialization voltage Vini to a potential corresponding to the first video voltage Vsig1, and the potential of the gate (third terminal) of the drive transistor 342 increases from a potential corresponding to the initialization voltage Vini to a potential corresponding to the second video voltage Vsig2.

At time t26, the logic of the first scan voltage SG1 is switched from "H" to "L", which causes the pixel switches 331 and 332 to be in a non-conductive state, and the video voltage writing operation in the second period of the second horizontal period is ended. Hereinafter, the video voltage writing operation in the second period of the second horizontal period may be referred to as a "first video voltage writing operation". Subsequently at time t27, the logic of the first video voltage output timing control signal xasw2-1 and the logic of the second video voltage output timing control signal xasw2-2 are switched from "H" to "L", which causes the video signal driver 100 to stop loading the data of the first video voltage Vsig1 and the second video voltage Vsig2. In the following description, the period from time t25 to time t26 in the second period of the second horizontal period is referred to as a "first video voltage writing period". In the first video voltage writing period, the first video voltage Vsig1 is written in the subpixel Rpix, and the second video voltage Vsig2 is written in the subpixel Bpix.

At time t29 in the second horizontal period, the logic of the first video voltage output timing control signal xasw2-1 and the logic of the second video voltage output timing control signal xasw2-2 are switched from "L" to "H", which causes the first video voltage control switch 103 and the second video voltage control switch 104 to be in a conductive state. Accordingly, the first video voltage Vsig1 is supplied to the first video signal line 110, and the second video voltage Vsig2 is supplied to the second video signal line 120. Subsequently at time t30, the logic of the second scan voltage SG2 is switched from "L" to "H", which causes the pixel switches 333 and 334 to be in a conductive state. With this process, the potential of the gate (third terminal) of the drive transistor 343 increases from a potential corresponding to the initialization voltage Vini to a potential corresponding to the first video voltage Vsig1, and the potential of the gate (third terminal) of the drive transistor 344 increases from a potential corresponding to the initialization voltage Vini to a potential corresponding to the second video voltage Vsig2.

At time t31, the logic of the second scan voltage SG2 is switched from "H" to "L", which causes the pixel switches 333 and 334 to be in a non-conductive state, and the video voltage writing operation in the third period of the second horizontal period is ended. Hereinafter, the video voltage writing operation in the third period of the second horizontal period may be referred to as a "second video voltage writing operation". Subsequently at time t32, the logic of the first video voltage output timing control signal xasw2-1 and the logic of the second video voltage output timing control signal xasw2-2 are switched from "H" to "L", which causes the video signal driver 100 to stop loading the data of the first video voltage Vsig1 and the second video voltage Vsig2. In the following description, the period from time t30 to time t31 in the third period of the second horizontal period is referred to as a "second video voltage writing period". In the second video voltage writing period, the first video voltage Vsig1 is written in the subpixel Gpix, and the second video voltage Vsig2 is written in the subpixel Wpix.

The organic light-emitting diodes 371, 372, 373, and 374 emit light during a period from the first and the second video voltage writing periods until time t11 in the first horizontal period of a subsequent frame at which the logic of the light emission control signal BG is switched from "H" to "L".

The display apparatus 1 according to the first embodiment performs the display operation of a one-frame video signal Vdisp such that the reset operation, the offset canceling operation, and the video voltage writing operation described above are performed for each pixel row in order by being staggered by one horizontal period (1H).

The following describes striped non-uniformity of luminance that occurs on a displayed image on the organic EL panel 10 including organic EL elements as light-emitting elements.

As described above, the first embodiment deals with the organic EL panel 10 that is manufactured by applying the annealing process to the array process. In the annealing process, a silicon thin film is irradiated with a line beam for crystallization. In this process, irradiation speed of the line beam varies periodically, which may result in striped non-uniformity of luminance on the displayed image. The non-uniformity of irradiation in the annealing process may cause performance of the TFTs on a substrate to be nonuniform from region to region, which may be a possible cause of this striped non-uniformity of luminance on the displayed image.

The inventor of the present disclosure has found that the striped non-uniformity of luminance, which is caused by the non-uniformity of line beam irradiation in the annealing process, is viewed differently depending on the tone of the video signal. The inventor has found that the striped non-uniformity of luminance on a displayed image is viewed differently depending on the duration of an initialization period (first period) in the series of operations including the initialization operation, the writing operation of the first video voltage Vsig1, and the writing operation of the second video voltage Vsig2. More specifically, setting the initialization period (first period) to be short when the tone of the video signal Vdisp is relatively high reduces the striped non-uniformity of luminance on a displayed image; whereas setting the initialization period (first period) to be long when the tone of the video signal Vdisp is relatively low reduces the striped non-uniformity of luminance on a displayed image.

Figure 5:
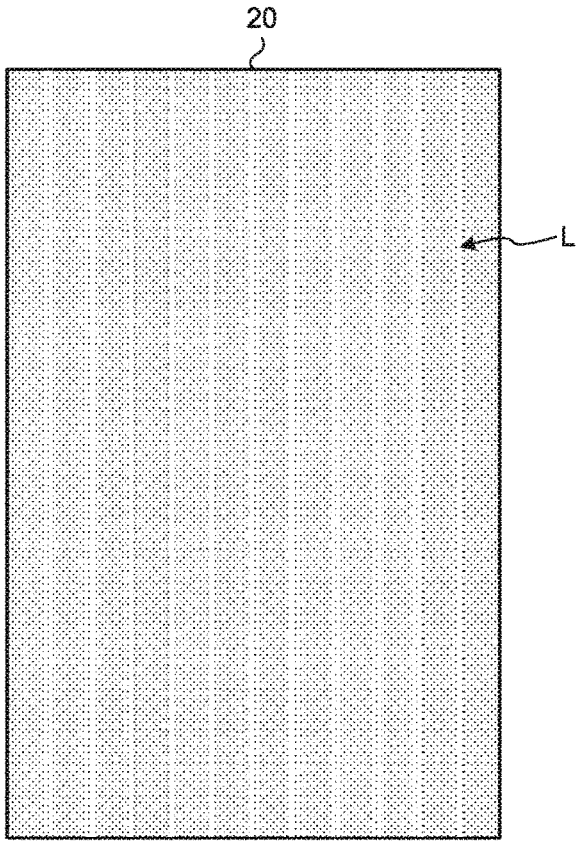
FIG. 5 is a diagram illustrating an example of striped non-uniformity of luminance that is viewed on a displayed image in a display region.
Figure 6:
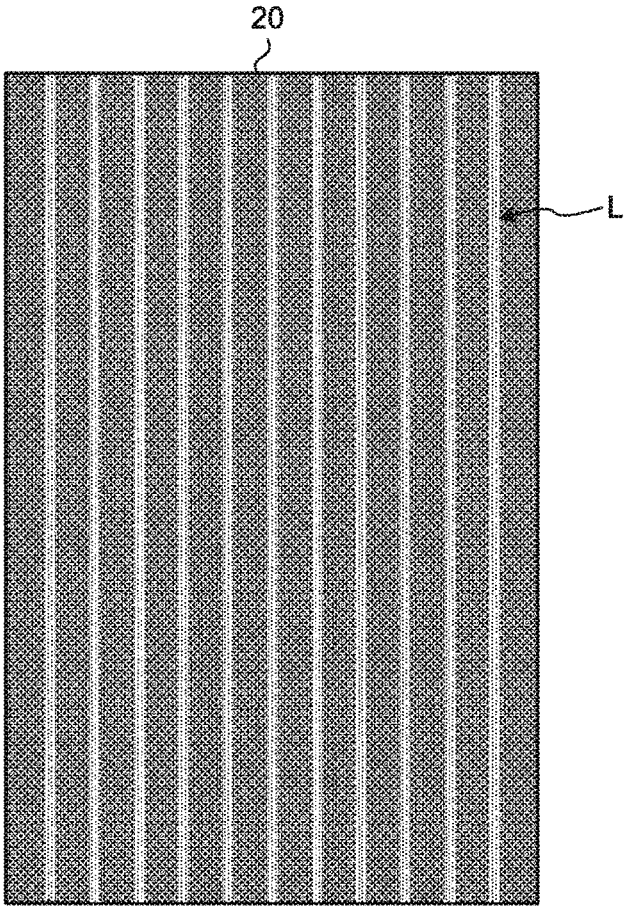
FIG. 6 is a diagram illustrating another example of striped non-uniformity of luminance that differs from FIG. 5 and is viewed on a displayed image in the display region.

FIG. 5 is a diagram illustrating an example of the striped non-uniformity of luminance that is viewed on a displayed image in the display region. FIG. 6 is a diagram illustrating another example of the striped non-uniformity of luminance that differs from FIG. 5 and is viewed on a displayed image in the display region.

FIG. 5 illustrates an example of the striped non-uniformity of luminance that is viewed when the tone of the video signal Vdisp is relatively high. FIG. 6 illustrates an example of the striped non-uniformity of luminance that is viewed when the tone of the video signal Vdisp is relatively low.

As illustrated in FIGS. 5 and 6, the non-uniformity of luminance having a stripe-like pattern L may be viewed on a displayed image in the display region 20 when the tone of the video signal Vdisp is relatively high or relatively low.

Figure 7:
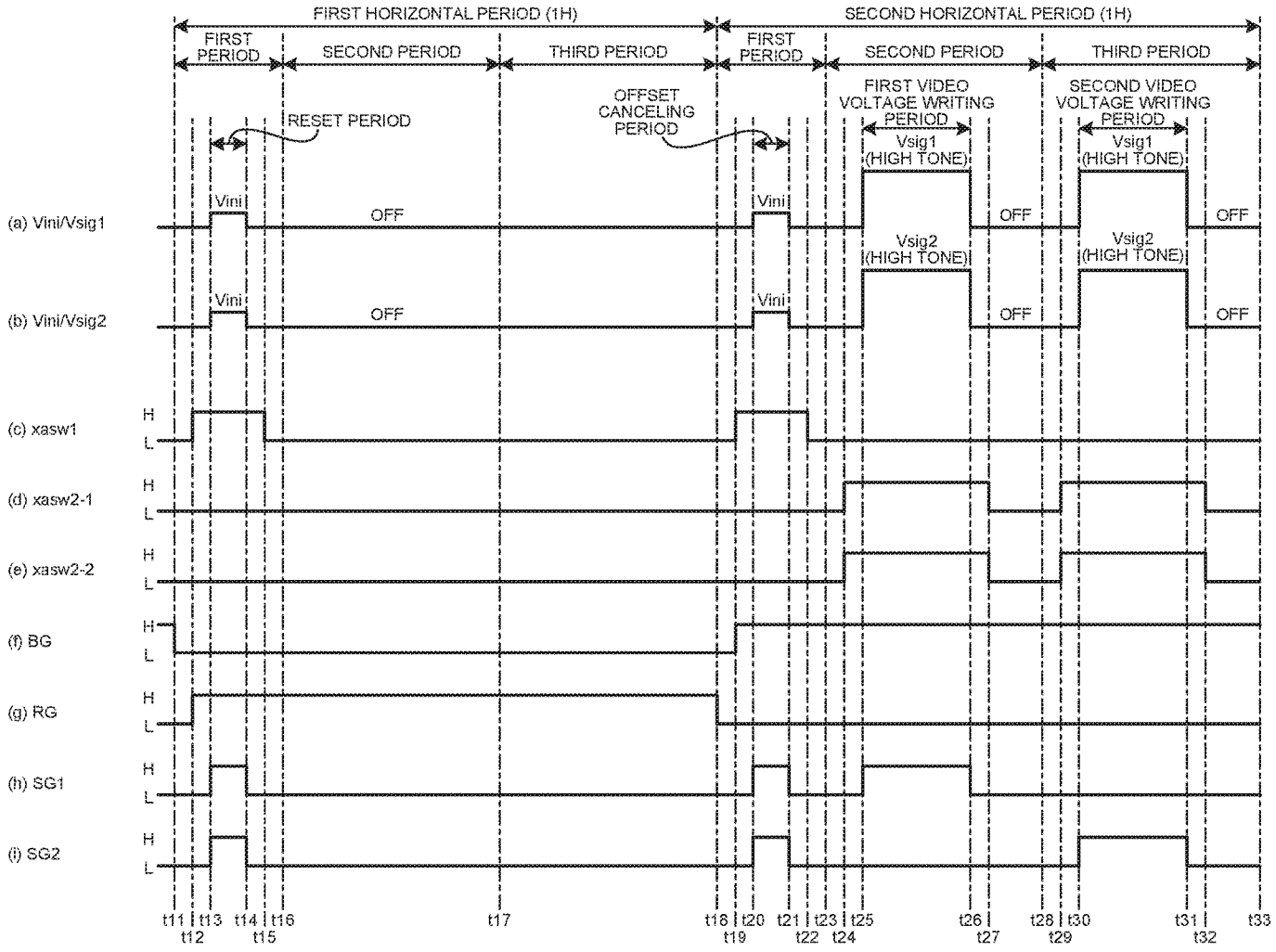
FIG. 7 is a timing chart of signals when a video signal has a relatively high tone.
Figure 8:
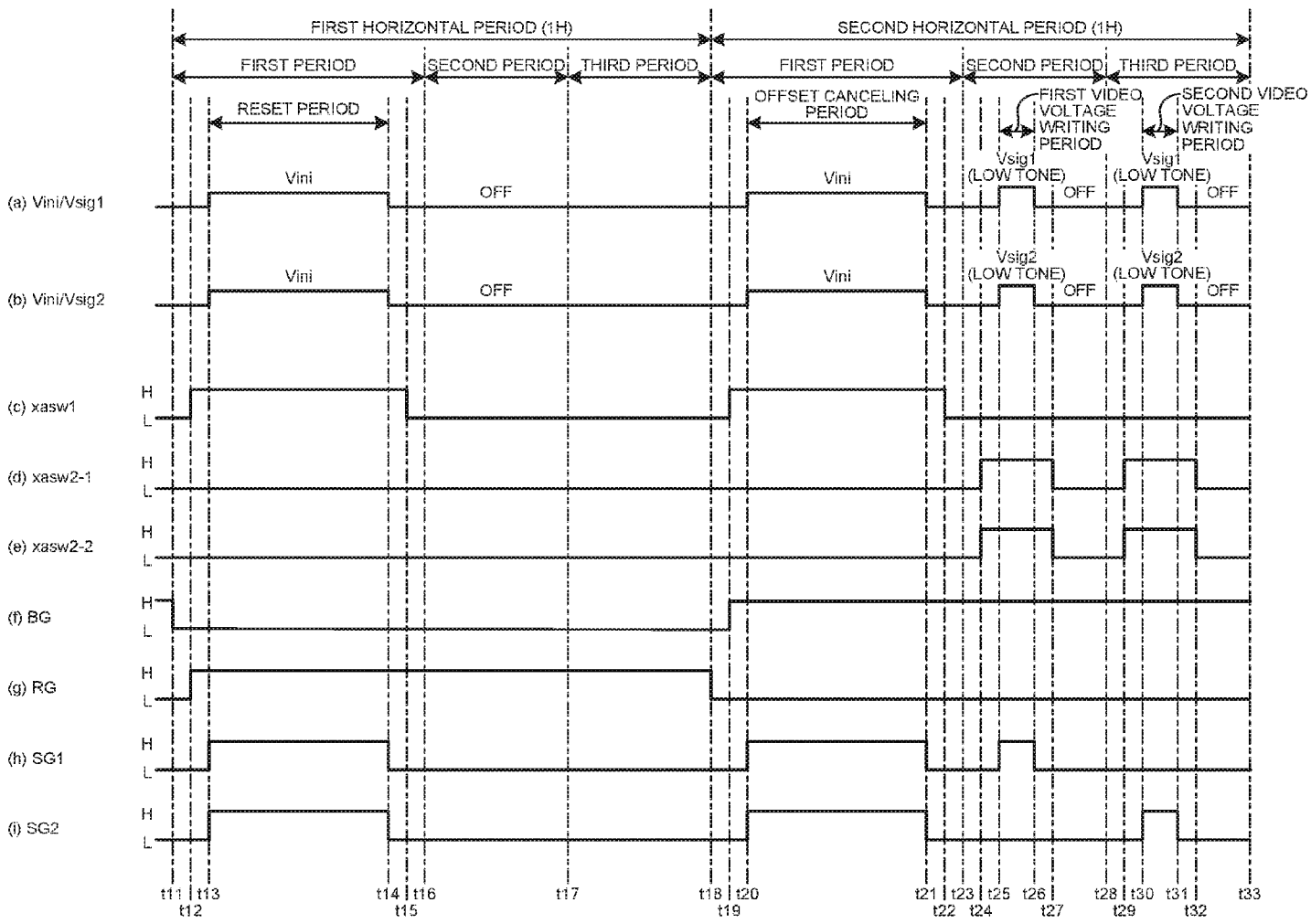
FIG. 8 is a timing chart of signals when the video signal has a relatively low tone.

FIG. 7 is a timing chart of the signals when the video signal has a relatively high tone. FIG. 8 is a timing chart of the signals when the video signal has a relatively low tone.

In the first embodiment, when the tone (the voltage level of the first video voltage Vsig1 and the second video voltage Vsig2) of the video signal Vdisp is higher than the tone of the video signal Vdisp in the example of FIG. 8, the first period in one horizontal period (1H) is shortened, whereas the second and the third periods in one horizontal period (1H) are extended as illustrated in FIG. 7. In other words, the reset period in the first horizontal period and the offset canceling period in the second horizontal period are shortened, whereas the first video voltage writing period and the second video voltage writing period in the second horizontal period are extended. This configuration can reduce the striped non-uniformity of luminance that is viewed on a displayed image when the tone (the voltage level of the first video voltage Vsig1 and the second video voltage Vsig2) of the video signal Vdisp is relatively high.

In the first embodiment, when the tone (the voltage level of the first video voltage Vsig1 and the second video voltage Vsig2) of the video signal Vdisp is lower than the tone of the video signal Vdisp in the example of FIG. 7, the first period in one horizontal period (1H) is extended, whereas the second and the third periods in one horizontal period (1H) are shortened as illustrated in FIG. 8. In other words, the reset period in the first horizontal period and the offset canceling period in the second horizontal period are extended, whereas the first video voltage writing period and the second video voltage writing period in the second horizontal period are shortened. This configuration can reduce the striped non-uniformity of luminance that is viewed on a displayed image when the tone (the voltage level of the first video voltage Vsig1 and the second video voltage Vsig2) of the video signal Vdisp is relatively low.

It is considered that changing the proportion of the reset period and the offset canceling period to the first video voltage writing period and the second video voltage writing period in two horizontal periods (2H), that is, changing the proportion of the first period to the second and the third periods in one horizontal period (1H) in accordance with the tone of the video signal Vdisp, eliminates the differences in performance of the TFTs caused by non-uniformity of line beam irradiation in the annealing process.

The following describes the controller 11 of the display apparatus 1 according to the first embodiment. In the following description, the aforementioned reset period and offset canceling period are each referred to as an "initialization period", and the first video voltage writing period and the second video voltage writing period are each referred to as a "video voltage writing period".

Figure 9:
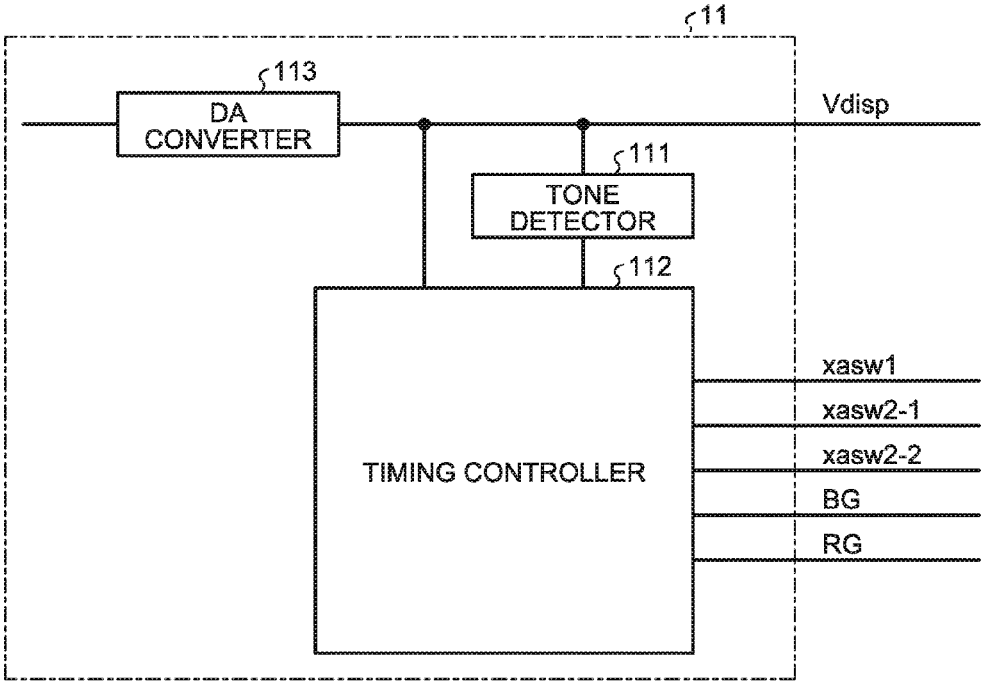
FIG. 9 is a diagram illustrating a configuration example of a controller of the display apparatus according to the embodiment.

FIG. 9 is a diagram illustrating a configuration example of the controller of the display apparatus according to the first embodiment. In the example of FIG. 9, the controller 11 is configured to detect the tone of each pixel from the video signal Vdisp that is an output signal from a DA converter 113.

Figure 10:
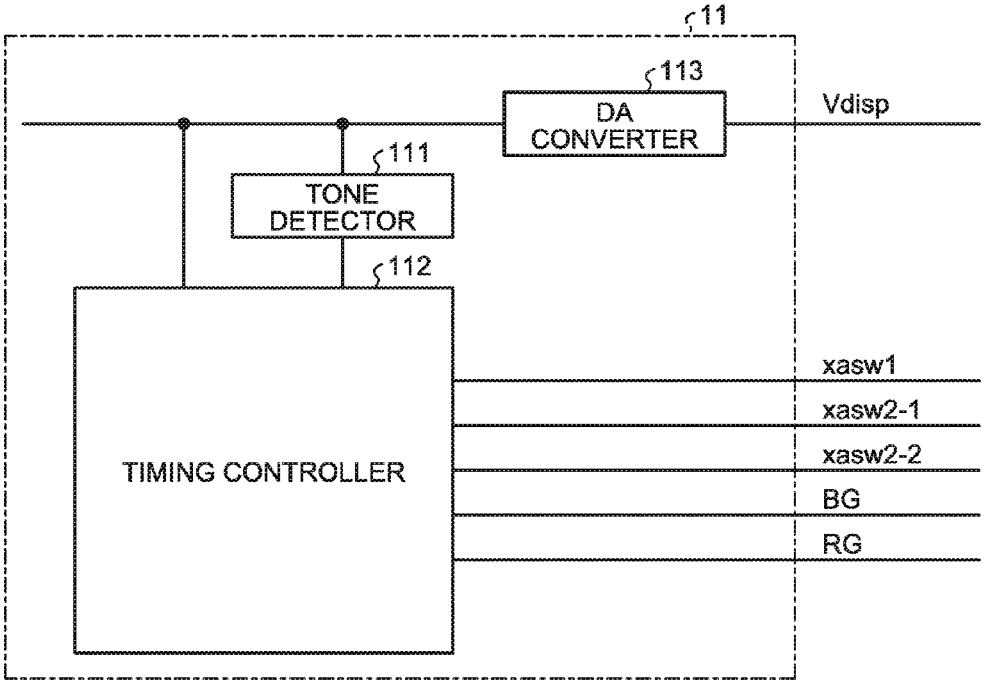
FIG. 10 is a diagram illustrating another configuration example of the controller of the display apparatus according to the embodiment that differs from FIG. 9.

FIG. 10 is a diagram illustrating another configuration example of the controller of the display apparatus according to the first embodiment that differs from FIG. 9. In the example of FIG. 10, the controller 11 is configured to detect the tone of each pixel from a digital input signal that is input to the DA converter 113.

Figure 11:
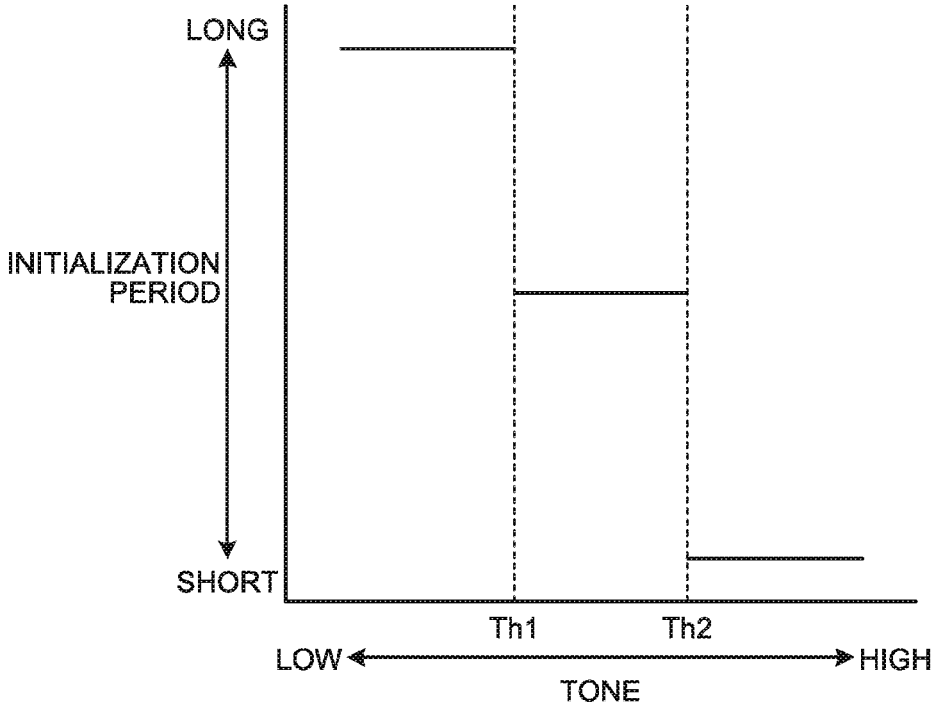
FIG. 11 is a diagram illustrating an example of a method of setting an initialization period in the display apparatus according to the embodiment.
Figure 12:
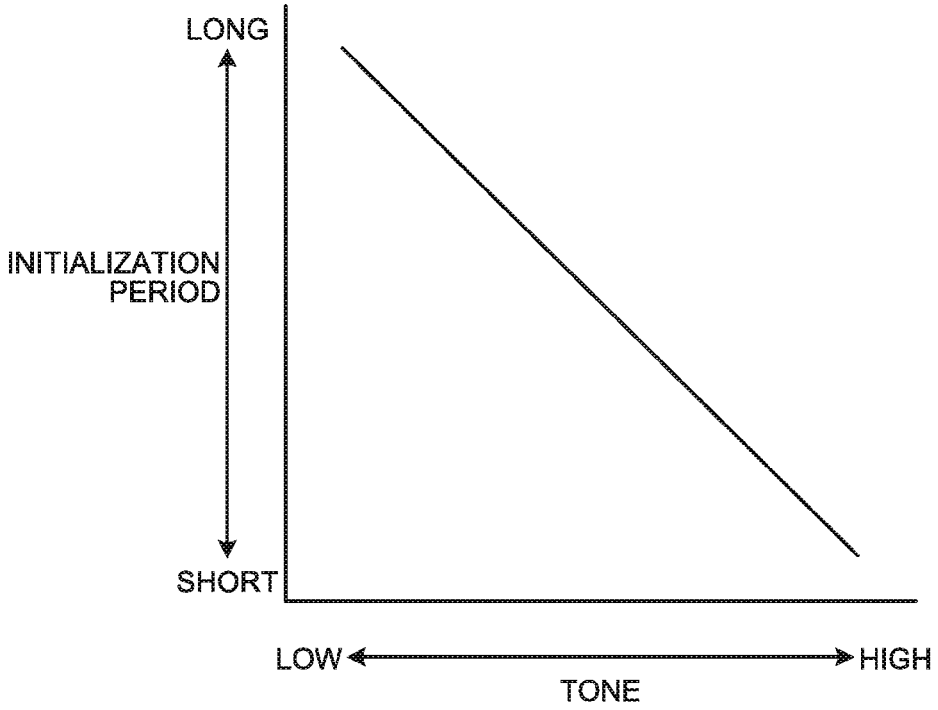
FIG. 12 is a diagram illustrating a first modification of the method of setting the initialization period in the display apparatus according to the embodiment.
Figure 13:
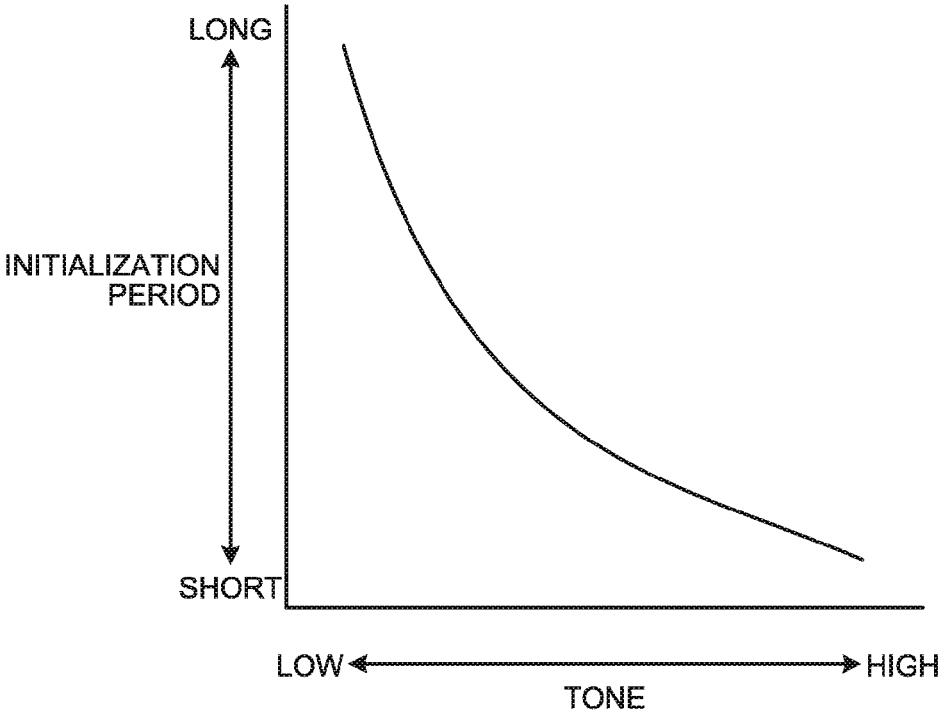
FIG. 13 is a diagram illustrating a second modification of the method of setting the initialization period in the display apparatus according to the embodiment.
Figure 14:
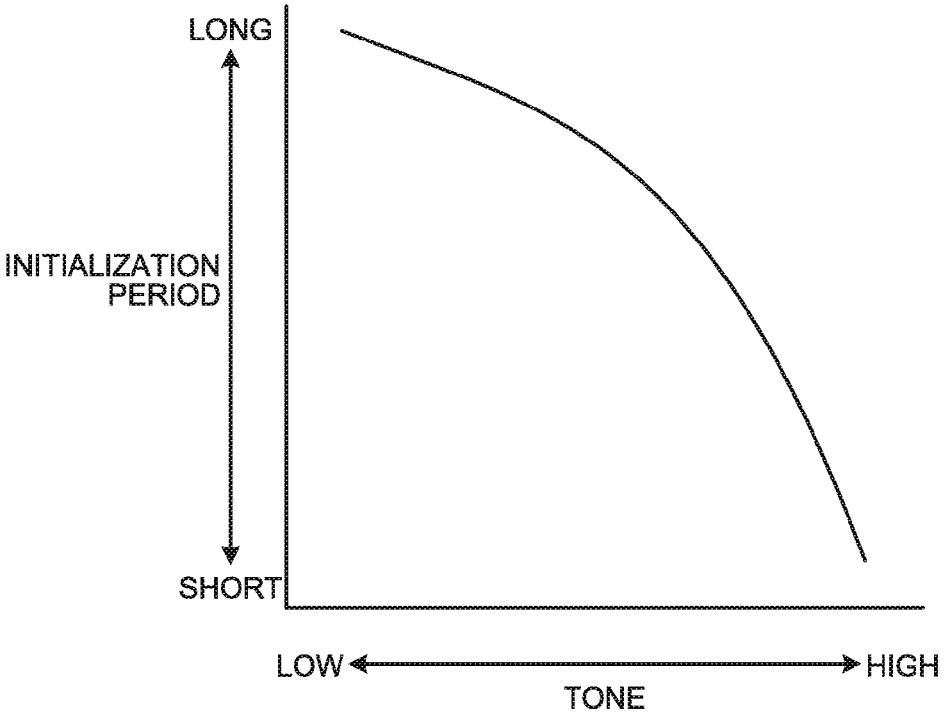
FIG. 14 is a diagram illustrating a third modification of the method of setting the initialization period in the display apparatus according to the embodiment.

FIG. 11 is a diagram illustrating an example of a method of setting the initialization period in the display apparatus according to the first embodiment. FIG. 12 is a diagram illustrating a first modification of the method of setting the initialization period in the display apparatus according to the first embodiment. FIG. 13 is a diagram illustrating a second modification of the method of setting the initialization period in the display apparatus according to the first embodiment. FIG. 14 is a diagram illustrating a third modification of the method of setting the initialization period in the display apparatus according to the first embodiment.

As illustrated in FIG. 11, the initialization period may be changed stepwise by using a threshold (thresholds Th1 and Th2 in FIG. 11) that is set for the tone (gradation level) of each pixel. In FIG. 11, for example, the initialization period for a region having a tone of the video signal lower than the threshold Th1 is set to be longer than the initialization period for a region having a tone equal to or higher than the threshold Th1, and the initialization period for a region having a tone of the video signal higher than the threshold Th2 is set to be shorter than the initialization period for a region having a tone equal to or lower than the threshold Th2. Although two thresholds Th1 and Th2 are set for the tone of each pixel in the example of FIG. 11, the number of thresholds to be set for the tone of each pixel may be one, or may be three or more.

As illustrated in the modifications of FIGS. 12, 13, and 14, for example, the initialization period may be shortened as the video signal has a higher tone. In the first modification illustrated in FIG. 12, the initialization period varies linearly as the tone varies. In the second modification illustrated in FIG. 13, the initialization period varies curvilinearly as the tone of the video signal varies in such a manner that the initialization period varies less significantly as the video signal has a higher tone. In the third modification illustrated in FIG. 14, the initialization period varies curvilinearly as the tone of the video signal varies in such a manner that the initialization period varies more significantly as the video signal has a higher tone.

To reduce the striped non-uniformity of luminance that is caused by the non-uniformity of line beam irradiation in the annealing process, the examples of the method of setting the initialization period in accordance with the tone of each pixel are described. However, these examples are described for illustrative purposes only, and thus, the method of setting the initialization period in accordance with the tone of each pixel is not intended to limit the scope of the present invention.

The controller 11 according to the first embodiment includes a configuration capable of setting the initialization period in accordance with the tone of the video signal by using the conversion table or the conversion formula that can achieve characteristics such as the characteristics illustrated in FIGS. 11, 12, 13, and 14.

Figure 15:
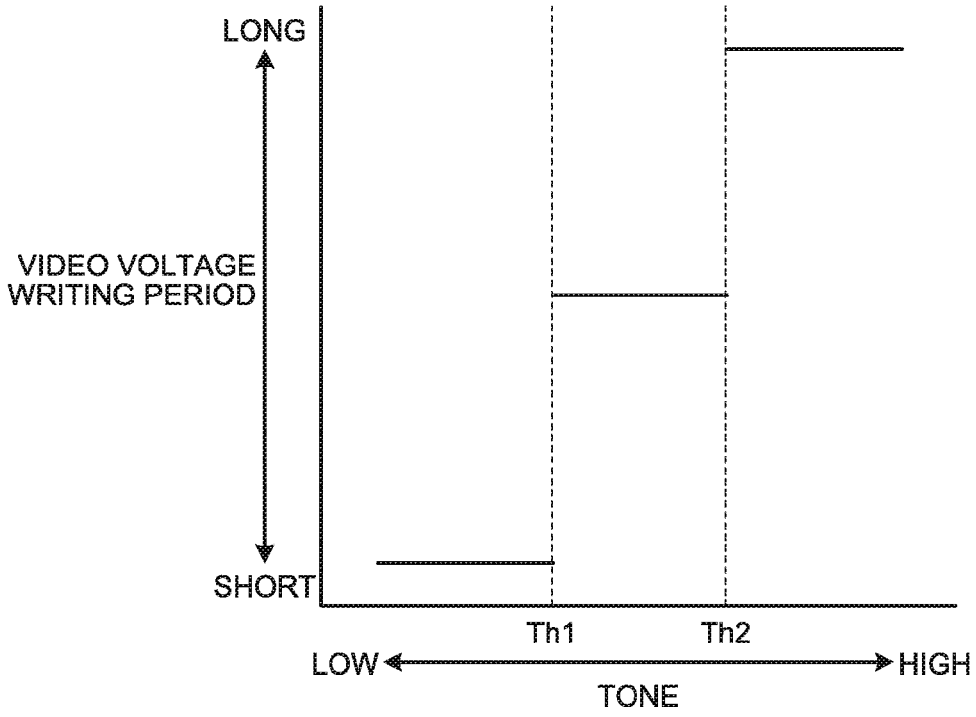
FIG. 15 is a diagram illustrating an example of a method of setting a video voltage writing period in the display apparatus according to the embodiment.
Figure 16:
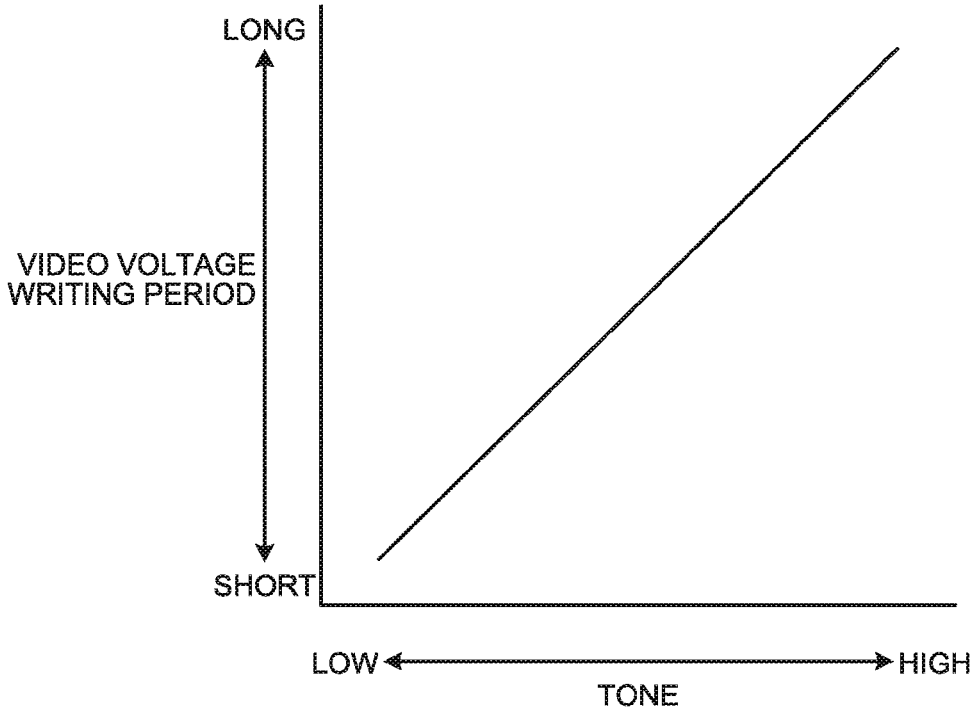
FIG. 16 is a diagram illustrating a first modification of the method of setting the video voltage writing period in the display apparatus according to the embodiment.
Figure 17:
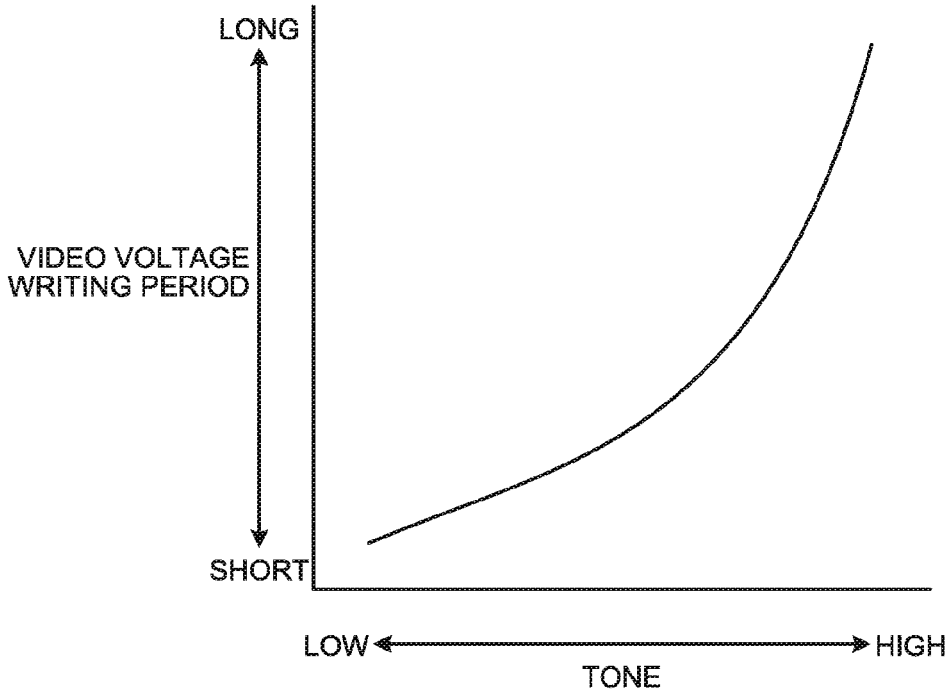
FIG. 17 is a diagram illustrating a second modification of the method of setting the video voltage writing period in the display apparatus according to the embodiment.
Figure 18:
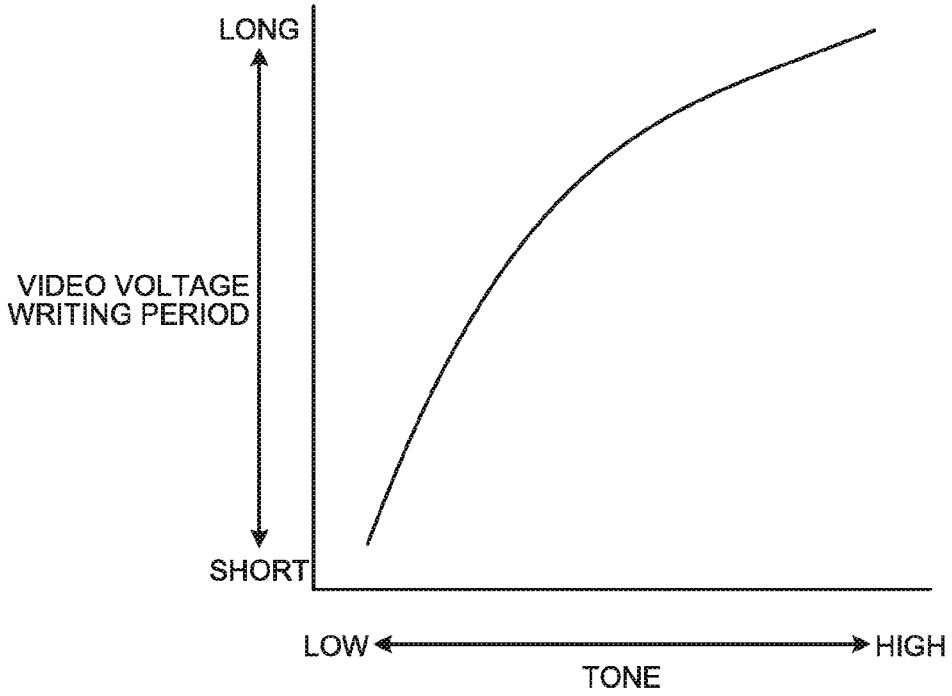
FIG. 18 is a diagram illustrating a third modification of the method of setting the video voltage writing period in the display apparatus according to the embodiment.

FIG. 15 is a diagram illustrating an example of a method of setting the video voltage writing period in the display apparatus according to the first embodiment. FIG. 16 is a diagram illustrating a first modification of the method of setting the video voltage writing period in the display apparatus according to the first embodiment. FIG. 17 is a diagram illustrating a second modification of the method of setting the video voltage writing period in the display apparatus according to the first embodiment. FIG. 18 is a diagram illustrating a third modification of the method of setting the video voltage writing period in the display apparatus according to the first embodiment.

As illustrated in FIG. 15, for example, the video voltage writing period may be changed stepwise by using a threshold (thresholds Th1 and Th2 in FIG. 15) that is set for the tone (gradation level) of each pixel. In FIG. 15, for example, the video voltage writing period for a region having a tone of the video signal lower than the threshold Th1 is set to be shorter than the video voltage writing period for a region having a tone equal to or higher than the threshold Th1, and the video voltage writing period for a region having a tone of the video signal higher than the threshold Th2 is set to be longer than the video voltage writing period for a region having a tone equal to or lower than the threshold Th2. Although two thresholds Th1 and Th2 are set for the tone of each pixel in the example of FIG. 15, the number of thresholds to be set for the tone of each pixel may be one, or may be three or more.

As illustrated in the modifications of FIGS. 16, 17, and 18, for example, the video voltage writing period may be extended as the video signal has a higher tone. In the first modification illustrated in FIG. 16, the video voltage writing period varies linearly as the tone varies. In the second modification illustrated in FIG. 17, the video voltage writing period varies curvilinearly as the tone of the video signal varies in such a manner that the video voltage writing period varies more significantly as the video signal has a higher tone. In the third modification illustrated in FIG. 18, the video voltage writing period varies curvilinearly as the tone of the video signal varies in such a manner that the video voltage writing period varies less significantly as the video signal has a higher tone.

To reduce the striped non-uniformity of luminance that is caused by the non-uniformity of line beam irradiation in the annealing process, the examples of the method of setting the video voltage writing period in accordance with the tone of each pixel are described. However, these examples are described for illustrative purposes only, and thus, the method of setting the video voltage writing period in accordance with the tone of each pixel is not intended to limit the scope of the present invention.

The controller 11 according to the first embodiment includes a configuration capable of setting the video voltage writing period in accordance with the tone of the video signal by using the conversion table or the conversion formula that can achieve characteristics such as the characteristics illustrated in FIGS. 15, 16, 17, and 18.

Thus, the display apparatus according to the first embodiment can eliminate the striped non-uniformity of luminance that is caused by the non-uniformity of line beam irradiation in the annealing process by controlling the initialization period and the video voltage writing period in accordance with the tone of the video signal, the initialization period being a period in which the initialization voltage Vini is applied to the pixels, the video voltage writing period being a period in which the first video voltage Vsig1 (second video voltage Vsig2) is applied to the pixels.

The configuration of the embodiment above is applied to the display apparatus in which the pixels each include four subpixels. The configuration of the embodiment above can be applied to an apparatus in which the reset operation and the writing operation are performed pixel by pixel, for example. The embodiment above is applicable to any configuration that performs initialization before writing.

In the embodiment above, the tone of each pixel is detected and used for setting the duration of the initialization period or the video voltage writing period. In some embodiments, the display region 20 may be divided into a plurality of regions, the average of tone values may be calculated for each divided region, and the initialization period and/or the video voltage writing period may be set for each divided region in accordance with the average of the tone values. For example, the duration of the initialization period and/or the video voltage writing period may be set differently between a relatively high tone region and a relatively low tone region for each frame.

In the embodiment above, the controller 11 sets the initialization period and/or the video voltage writing period in accordance with the tone of each pixel. In some embodiments, the initialization period and/or the video voltage writing period may be set by an observer through the operation of an input unit (not illustrated) when the observer visually identifies the striped non-uniformity of luminance that is caused by the non-uniformity of line beam irradiation in the annealing process.

As described above, the display apparatus 1 according to the embodiment above is configured to control the initialization period and the video voltage writing period in accordance with the tone of the video signal, thereby reducing the striped non-uniformity of luminance that is caused by the non-uniformity of line beam irradiation in the annealing process, the initialization period being a period in which the initialization voltage Vini is applied to the pixels, and the video voltage writing period being a period in which the video voltage (the first video voltage Vsig1, the second video voltage Vsig2) is applied to the pixels.

It is preferred that the video voltage writing period is made to be longer when the video signal has a tone higher than a certain threshold than the period when the video signal has a tone equal to or lower than the threshold.

It is preferred that the initialization period is made to be longer when the video signal has a tone lower than a certain threshold than the period when the video signal has a tone equal to or higher than the threshold.

It is preferred that the initialization period is shortened as the video signal has a higher tone.

It is preferred that the video voltage writing period is extended as the video signal has a higher tone.

According to the embodiment above, the display apparatus 1 that can reduce the striped non-uniformity of luminance that is caused by the annealing process can be provided.

Although, in the embodiment above, each of the pixels 30 is configured by the four subpixels Rpix, Gpix, Bpix, and Wpix, the configuration of the pixels 30 is not limited to this. For example, each of the pixels 30 may be configured by three subpixels that emit light in luminescent colors of red (R), green (G), and blue (B). The luminescent colors of the subpixels are not limited to these particular examples.

In the embodiment above, the reset period and the offset canceling period in which the initialization voltage Vini is applied to the pixels are referred to as the "initialization period", and the "initialization period" is controlled in accordance with the tone of the video signal. In some embodiments, the "initialization period" may include only the reset period without including the offset canceling period, and the "initialization period" may be controlled in accordance with the tone of the video signal. In some embodiments, the "initialization period" may include only the offset canceling period without including the reset period, and the "initialization period" may be controlled in accordance with the tone of the video signal.

Figure 19:
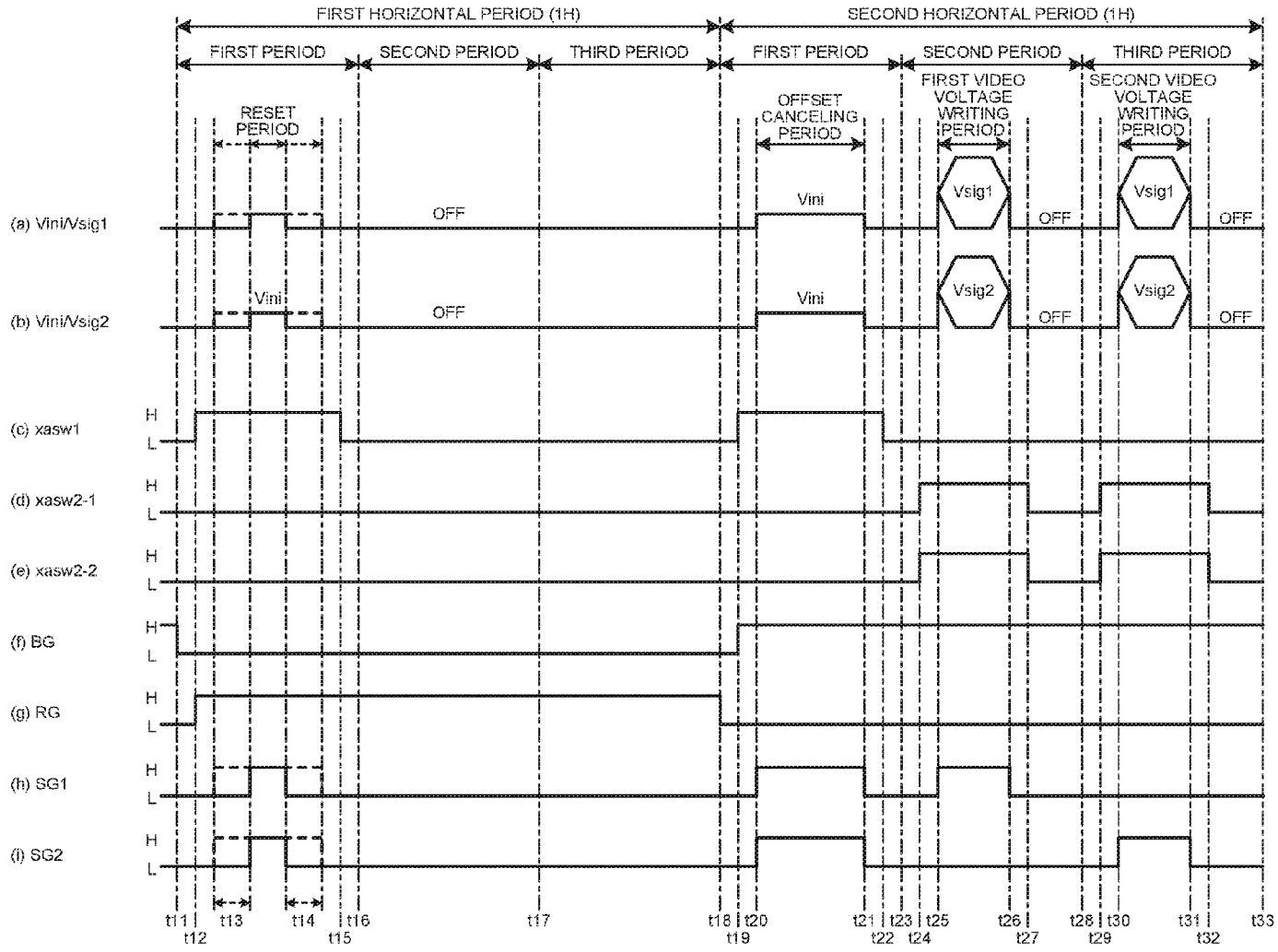
FIG. 19 illustrates a first modification of the timing chart of the control signals used in the display apparatus according to the embodiment.
Figure 20:
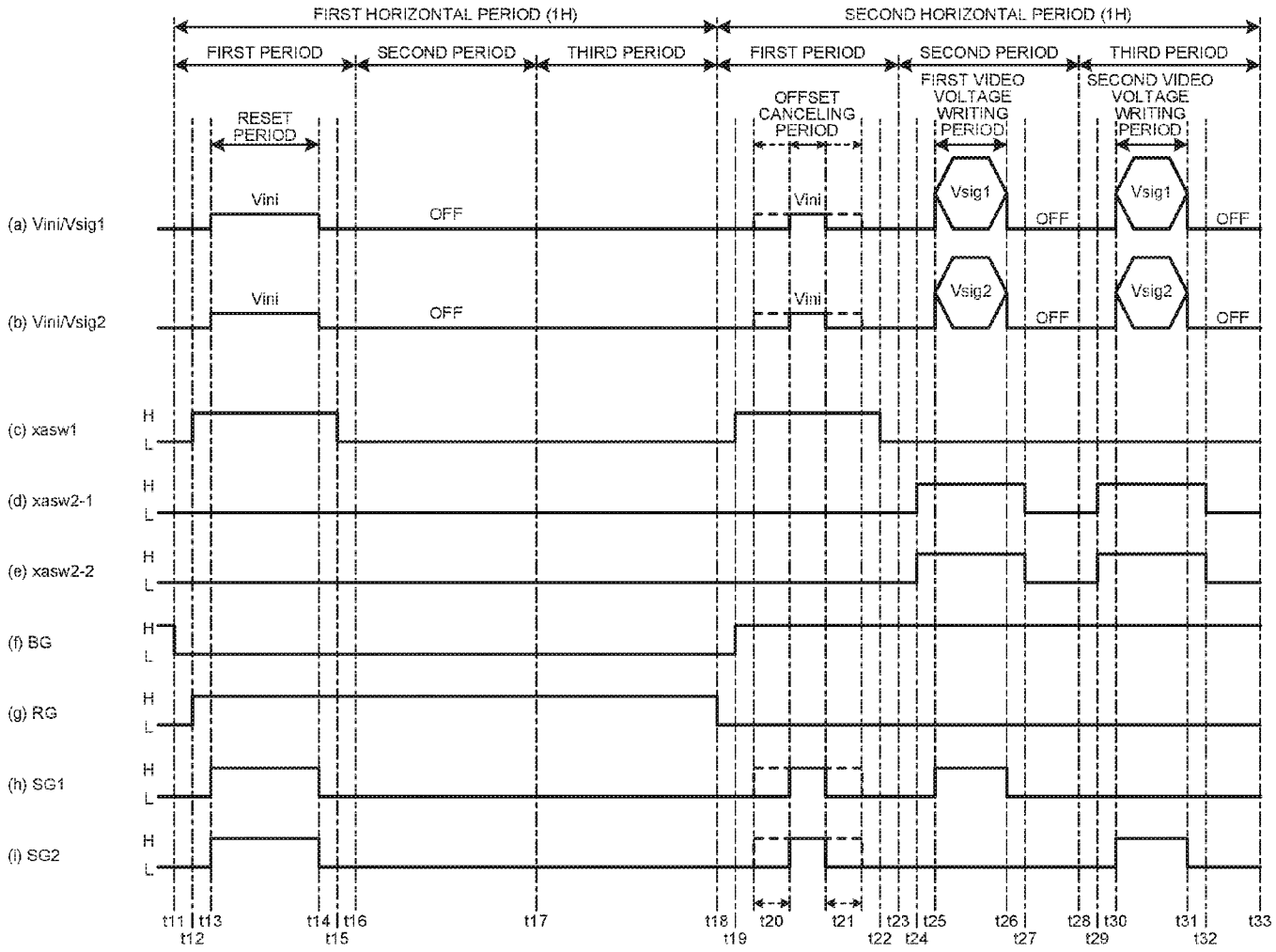
FIG. 20 illustrates a second modification of the timing chart of the control signals used in the display apparatus according to the embodiment.

FIG. 19 illustrates a first modification of the timing chart of the control signals used in the display apparatus according to the first embodiment. FIG. 20 illustrates a second modification of the timing chart of the control signals used in the display apparatus according to the first embodiment.

FIG. 19 illustrates an example of controlling the reset period in the first period of the first horizontal period in accordance with the tone of the video signal. FIG. 20 illustrates an example of controlling the offset canceling period in the first period of the second horizontal period in accordance with the tone of the video signal.

As illustrated in FIG. 19, only the reset period may be controlled in accordance with the tone of the video signal without changing the duration of the offset canceling period. As illustrated in FIG. 20, only the offset canceling period may be controlled in accordance with the tone of the video signal without changing the duration of the reset period.

The constituent elements described in the embodiment above may be combined as appropriate. It should be appreciated that, in addition to the operational effects according to the aspects of the embodiment above, other operational effects that are apparent from the description above or that can be easily considered by those skilled in the art are provided by the present invention.

What is claimed is:

1. A display apparatus comprising:

a plurality of pixels including light-emitting elements;

a video signal driver configured to apply a video voltage or an initialization voltage to the pixels based on a video signal;

a scan signal driver configured to apply a scan voltage to the pixels based on the video signal; and a controller configured to control an initialization period in which the initialization voltage is applied to the pixels and a video voltage writing period in which the video voltage is applied to the pixels, in accordance with a tone of the video signal, wherein the controller makes the video voltage writing period longer when the video signal has a tone higher than a certain threshold than the period when the video signal has a tone equal to or lower than the threshold.

2. The display apparatus according to claim 1, wherein the controller makes the initialization period longer when the video signal has a tone lower than a certain threshold than the period when the video signal has a tone equal to or higher than the threshold.

3. A display apparatus comprising:

a plurality of pixels including light-emitting elements;

a video signal driver configured to apply a video voltage or an initialization voltage to the pixels based on a video signal;

a scan signal driver configured to apply a scan voltage to the pixels based on the video signal; and a controller configured to control an initialization period in which the initialization voltage is applied to the pixels and a video voltage writing period in which the video voltage is applied to the pixels, in accordance with a tone of the video signal, wherein the controller makes the initialization period longer when the video signal has a tone lower than a certain threshold than the period when the video signal has a tone equal to or higher than the threshold.

4. A display apparatus comprising:

a plurality of pixels including light-emitting elements;

a video signal driver configured to apply a video voltage or an initialization voltage to the pixels based on a video signal;

a scan signal driver configured to apply a scan voltage to the pixels based on the video signal; and a controller configured to control an initialization period in which the initialization voltage is applied to the pixels and a video voltage writing period in which the video voltage is applied to the pixels, in accordance with a tone of the video signal, wherein the controller shortens the initialization period as the video signal has a higher tone.

5. The display apparatus according to claim 4, wherein the controller controls the initialization period such that the initialization period is increased linearly as the tone of the video signal becomes lower.

6. The display apparatus according to claim 4, wherein the controller controls the initialization period such that the initialization period is increased more as the tone of the video signal becomes lower.

7. The display apparatus according to claim 4, wherein the controller controls the initialization period such that the initialization period is increased less as the tone of the video signal becomes lower.

8. The display apparatus according to claim 4, wherein the controller extends the video voltage writing period as the video signal has a higher tone.

9. The display apparatus according to claim 8, wherein the controller controls the video voltage writing period such that the video voltage writing period is increased linearly as the tone of the video signal becomes higher.

10. The display apparatus according to claim 8, wherein the controller controls the video voltage writing period such that the video voltage writing period is increased more as the tone of the video signal becomes higher.

11. The display apparatus according to claim 8, wherein the controller controls the video voltage writing period such that the video voltage writing period is increased less as the tone of the video signal becomes higher.

12. A display apparatus comprising:

a plurality of pixels including light-emitting elements;

a video signal driver configured to apply a video voltage or an initialization voltage to the pixels based on a video signal;

a scan signal driver configured to apply a scan voltage to the pixels based on the video signal; and a controller configured to control an initialization period in which the initialization voltage is applied to the pixels and a video voltage writing period in which the video voltage is applied to the pixels, in accordance with a tone of the video signal, wherein the controller extends the video voltage writing period as the video signal has a higher tone.

13. The display apparatus according to claim 12, wherein the controller controls the video voltage writing period such that the video voltage writing period is increased linearly as the tone of the video signal becomes higher.

14. The display apparatus according to claim 12, wherein the controller controls the video voltage writing period such that the video voltage writing period is increased more as the tone of the video signal becomes higher.

15. The display apparatus according to claim 12, wherein the controller controls the video voltage writing period such that the video voltage writing period is increased less as the tone of the video signal becomes higher.

* * * * *